US008217324B2

(12) United States Patent
Chi et al.

(10) Patent No.: US 8,217,324 B2
(45) **Date of Patent: *Jul. 10, 2012**

(54) SUSCEPTOR ASSEMBLY FOR USE IN A MICROWAVE OVEN

(75) Inventors: Cheng-Hang Chi, Midlothian, VA (US); Nicole L. Blankenbeckler, Richmond, VA (US); Mehrdad Mehdizadeh, Avondale, PA (US); Ronald Jack Riegert, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 1427 days.

This patent is subject to a terminal disclaimer.

(21) Appl. No.: 11/511,962

(22) Filed: Aug. 29, 2006

(65) Prior Publication Data

US 2007/0187399 A1 Aug. 16, 2007

Related U.S. Application Data

(60) Provisional application No. 60/712,066, filed on Aug. 29, 2005, provisional application No. 60/712,154, filed on Aug. 29, 2005.

(51) Int. Cl.
*H05B 6/80* (2006.01)
*H05B 6/64* (2006.01)

(52) U.S. Cl. ..... 219/730; 219/728; 219/732; 219/745; 219/763

(58) Field of Classification Search ..... 219/729, 219/730, 751, 752, 753, 754, 759, 762, 763, 219/732; 426/107, 109, 110, 113; 29/831, 29/827, 837, 825

See application file for complete search history.

(56) References Cited

U.S. PATENT DOCUMENTS

| | | | | |
|---|---|---|---|---|
| 3,946,187 | A * | 3/1976 | MacMaster et al. | 219/728 |
| 4,144,438 | A | 3/1979 | Gelman et al. | |
| 4,424,430 | A | 1/1984 | Almgren et al. | |
| 4,486,640 | A | 12/1984 | Bowen et al. | |
| 4,629,849 | A | 12/1986 | Mizutani et al. | |
| 4,896,009 | A | 1/1990 | Pawlowski | |
| 4,904,836 | A * | 2/1990 | Turpin et al. | 219/759 |

(Continued)

FOREIGN PATENT DOCUMENTS

| | | |
|---|---|---|
| EP | 0 049 551 | 4/1982 |

(Continued)

OTHER PUBLICATIONS

Papadakis et al. "A versatile and Inexpensive Technique for Measuring Color of Foods", Food Technology, vol. 54, No. 12, Dec. 2000, pp. 48-51.

*Primary Examiner* — Henry Yuen
*Assistant Examiner* — Hung D Nguyen

(57) ABSTRACT

A susceptor assembly includes a generally planar susceptor having an electric field director structure mechanically connected thereto. The field director structure includes at least one, but more preferably, a plurality of two or more vanes mechanically connected to the susceptor. Each vane has a surface at least a portion of which is electrically conductive. The vane(s) are most preferably disposed substantially orthogonal to the planar susceptor. The connection may be either a fixed or a flexible articulating connection. In use, such as in the presence of a standing electromagnetic wave generated within a microwave oven, only an attenuated electric field component of the electromagnetic wave exists in a plane tangent to the surface of the vane in the vicinity of the conductive portion of the vane.

26 Claims, 28 Drawing Sheets

U.S. PATENT DOCUMENTS

| | | | | |
|---|---|---|---|---|
| 4,943,439 | A | | 7/1990 | Andreas et al. |
| 4,972,059 | A | | 11/1990 | Wendt et al. |
| 4,992,638 | A | | 2/1991 | Hewitt et al. |
| 5,006,684 | A | | 4/1991 | Wendt et al. |
| 5,185,506 | A | * | 2/1993 | Walters ..... 219/730 |
| 5,217,765 | A | * | 6/1993 | Parks ..... 428/34.2 |
| 5,220,142 | A | | 6/1993 | La Maire et al. |
| 5,242,106 | A | | 9/1993 | Gulliver |
| 5,247,149 | A | | 9/1993 | Peleg |
| 5,310,977 | A | | 5/1994 | Stenkamp et al. |
| 5,800,724 | A | | 9/1998 | Habeger et al. |
| 5,877,479 | A | | 3/1999 | Yu |
| 5,900,264 | A | | 5/1999 | Gics |
| 5,986,248 | A | | 11/1999 | Matsuno et al. |
| 6,063,415 | A | | 5/2000 | Walters |
| 6,359,271 | B1 | | 3/2002 | Gidner et al. |
| 6,359,272 | B1 | | 3/2002 | Sadek et al. |
| 6,414,290 | B1 | | 7/2002 | Cole et al. |
| 2004/0000545 | A1 | | 1/2004 | Kim |
| 2005/0230383 | A1 | | 10/2005 | Romeo et al. |
| 2006/0011620 | A1 | | 1/2006 | Tsontzidis et al. |

FOREIGN PATENT DOCUMENTS

| | | | |
|---|---|---|---|
| EP | 0 332 782 | A1 | 9/1989 |
| EP | 0 943 558 | | 9/1999 |
| EP | 1 479 619 | | 11/2004 |
| FR | 2694876 | | 2/1994 |
| GB | 2 329 815 | | 3/1999 |
| JP | 04-371724 | | 12/1992 |
| JP | 6-65278 | U | 9/1994 |
| JP | 08 203668 | | 8/1996 |
| JP | 09-280569 | | 10/1997 |
| JP | 2004-309082 | | 4/2004 |
| WO | WO 2005/032318 | A1 | 4/2005 |
| WO | WO 2005/085091 | A2 | 9/2005 |
| WO | WO 2006/113886 | | 10/2006 |

* cited by examiner

Results of Example 6

Results of Example 7

SUSCEPTOR ASSEMBLY FOR USE IN A MICROWAVE OVEN

This application claims the benefit of U.S. Provisional Applications; 60/712,066 and 60/712,154 each of which was filed 29 Aug. 2005, and is incorporated as a part hereof for all purposes

FIELD OF THE INVENTION

The present invention is directed to a susceptor assembly including a field director arrangement which, when used in a microwave oven having a turntable or mode stirrer is adapted to redirect and to relocate regions within the oven having relatively high electric field intensity so that a food product is able to be more uniformly warmed, cooked, or browned.

BACKGROUND OF THE INVENTION

Microwave ovens use electromagnetic energy at frequencies that vibrate molecules within a food product to produce heat. The heat so generated warms or cooks the food. However, the food is not raised to a sufficiently high temperature to brown its surface to a crisp texture (and still keep the food edible).

To achieve these visual and tactile aesthetics a susceptor formed of a substrate having a lossy susceptor material thereon may be placed adjacent to the surface of the food. When exposed to microwave energy the material of the susceptor is heated to a temperature sufficient to cause the food's surface to brown and crisp.

The walls of a microwave oven impose boundary conditions that cause the distribution of electromagnetic field energy within the volume of the oven to vary. These variations in intensity and directionality of the electromagnetic field, particularly the electric field constituent of that field, create relatively hot and cold regions in the oven. These hot and cold regions cause the food to warm or to cook unevenly. If a microwave susceptor material is present the browning and crisping effect is similarly uneven.

To counter this uneven heating effect a turntable may be used to rotate a food product along a circular path within the oven. Each portion of the food is exposed to a more uniform level of electromagnetic energy. However, the averaging effect occurs along circumferential paths and not along radial paths. Thus, the use of the turntable still creates bands of uneven heating within the food.

This effect may be more fully understood from the diagrammatic illustrations of FIGS. 1A and 1B.

FIG. 1A is a plan view of the interior of a microwave oven showing five regions ($H_1$ through $H_5$) of relatively high electric field intensity ("hot regions") and two regions $C_1$ and $C_2$ of relatively low electric field intensity ("cold regions"). A food product F having any arbitrary shape is disposed on a susceptor S which, in turn, is placed on a turntable T. The susceptor S is suggested by the dotted circle while the turntable is represented by the bold solid-line circle. Three representative locations on the surface of the food product F are illustrated by points J, K, and L. The points J, K, and L are respectively located at radial positions $P_1$, $P_2$ and $P_3$ of the turntable T. As the turntable T rotates each point follows a circular path through the oven, as indicated by the circular dashed lines.

As may be appreciated from FIG. 1A, during one full revolution point J passes through a single region $H_1$ of relatively high electric field intensity. During the same revolution the point K passes through a single smaller region $H_5$ of relatively high electric field intensity, while the point L experiences three regions $H_2$, $H_3$ and $H_4$ of relatively high electric field intensity. Rotation of the turntable through one complete revolution thus exposes each of the points J, K, and L to a different total amount of electromagnetic energy. The differences in energy exposure at each of the three points during one full rotation is illustrated by the plot of FIG. 1B.

Owing to the number of hot regions encountered and cold regions avoided, points J and L experience considerably more energy exposure than Point K. If the region of the food product in the vicinity of the path of point J is deemed fully cooked, then the region of the food product in the vicinity of the path of point L is likely to be overcooked or excessively browned (if a susceptor is present). On the other hand, the region of the food product in the vicinity of the path of point K is likely to be undercooked.

Since this non-uniform level of cooking owing to the presence of hot and cold regions is undesirable, it is believed advantageous to employ a field director structure, whether alone or in combination with a susceptor, that mitigates the effects of regions of relatively high and low electric field intensity within a microwave oven by redirecting and relocating these regions within the oven, so that food warms, cooks and browns more uniformly.

SUMMARY OF THE INVENTION

In its various aspects the present invention is directed to structures for use in mitigating the effects of hot and cold regions produced by a is standing electromagnetic wave within a microwave oven.

In a first aspect the present invention is directed to a susceptor assembly comprising a generally planar susceptor having an electric field director structure mechanically connected thereto. The planar susceptor includes an electrically lossy layer, usually supported on a non-conductive substrate.

The field director structure includes at least one, but more preferably, a plurality of two or more vanes mechanically connected to the susceptor. Each vane has a surface at least a portion of which is electrically conductive. A vane may be formed in any convenient configuration. The electrically conductive portion may take any of a variety of shapes on the surface of the vane or may be disposed over the entire surface of the vane.

The vane(s) may be connected to the planar susceptor so that the surface of the vane is oriented at an angle between about forty-five degrees (45°) and ninety degrees (90°) with respect to the planar susceptor. In the most preferred instance the vane(s) is(are) disposed substantially orthogonal to the planar susceptor. The connection may be either a fixed or a flexible articulating connection. In a fixed connection the vane is secured in a desired angular orientation (preferably substantially orthogonal) with respect to the planar susceptor. If the connection is a flexible articulating connection the surface of the vane is movable from a stored position to a deployed position. In the deployed position the surface of the vane is oriented at a desired angular orientation (preferably substantially orthogonal) with respect to the planar susceptor.

The edge profile of a vane may also take any of a variety of contours. A vane edge may have a straight edge contour, a bent edge contour, or a curved edge contour. The portion of the edge length occupied by the conductive portion of vane is preferably in the range from about 0.25 to about twice the wavelength of the standing electromagnetic wave generated within the oven.

The surface of the vane and the planar susceptor physically intersect along a line of intersection that extends in a generally transverse direction with respect to the planar susceptor. Preferably, the line of intersection extends in a generally radial direction passing through the center of the susceptor assembly. Alternatively, the line of intersection may originate from a point in the vicinity of the center. As yet further alternatives, the line of intersection may be offset or inclined with respect to a generally radial direction of the planar susceptor.

The electrically conductive portion of the vane is disposed no farther than a predetermined close distance from the electrically lossy layer of the planar susceptor such that extension of the conductive surface of the vane will lie along the line of intersection. The predetermined close distance is preferably less than 0.25 of the wavelength of a standing electromagnetic wave generated within the oven.

In use, such as in the presence of a standing electromagnetic wave generated within the oven, only an attenuated electric field component of the electromagnetic wave exists in a plane tangent to the surface of the vane in the vicinity of the conductive portion of the vane. The attenuation of the electric field component of the electromagnetic wave in the plane tangent to the surface of the vane results in the enhancement of the components of the electric field in the planar susceptor.

Rotation of the susceptor assembly within the oven, or variation of the standing electromagnetic wave generated within the oven (as by a mode stirrer) results in a substantially uniform warming, cooking and browning effect on a food product placed on the planar susceptor.

In another aspect the present invention is directed to a field director structure comprising one or more vanes so that, in use, the vane(s) is(are) able to be disposed in a predetermined orientation with respect to a predetermined reference plane within the oven. In the presence of a standing electromagnetic wave only an attenuated electric field component of the electromagnetic wave exists in a plane tangent to the surface of the vane(s) in the vicinity of the conductive portion thereon. The attenuation of the electric field component of the electromagnetic wave in the plane tangent to the surface of the vane results in the enhancement of the component of the electric field substantially orthogonal to the conductive surface. The field director structure in accordance with the present invention may be used with a planar susceptor, if desired.

In one embodiment the field director structure comprises at least a single vane having a surface thereon, at least a portion of the surface of the vane being electrically conductive. The vane has a first and a second end thereon. The vane may be supported by a suitable support member so that the vane(s) is(are) able to be disposed in a predetermined orientation with respect to a predetermined reference plane within the oven. If more than one vane is used, the vanes may or may not be connected to each other, as desired.

In other embodiments the field director is a collapsible structure comprising one or more vane(s) that is(are) able to made self-supporting so that, in use, the vane(s) is(are) able to be disposed in a predetermined orientation with respect to a predetermined reference plane within the oven.

A vane may have one or more fold or bend line(s) defined between the first and second ends of the vane along which the vane may be folded or bent into a self-supporting configuration. Alternatively, the vane be curved or have a region of flexure or curvature defined between the first and second ends so that the vane may be made self-supporting.

A collapsible field director structure may include an array of two or more planar or two or more curved vanes. At least a portion of the surface of each vane is electrically conductive. Each vane is flexibly connected at a point of connection to at least one other vane. The flexibly connected vanes are positionable with respect to each other whereby, in use, the array is self-supporting with each vane being disposed in a predetermined orientation with respect to a predetermined reference plane within the oven.

Use of a field director structure of the present invention in a microwave oven that includes a turntable or a mode stirrer results in a substantially uniform warming, cooking and browning effect on a food product.

BRIEF DESCRIPTION OF THE FIGURES

The invention will be more fully understood from the following detailed description, taken in connection with the accompanying drawings, which form a part of this application and in which.

DETAILED DESCRIPTION OF THE INVENTION

Figure 1A:
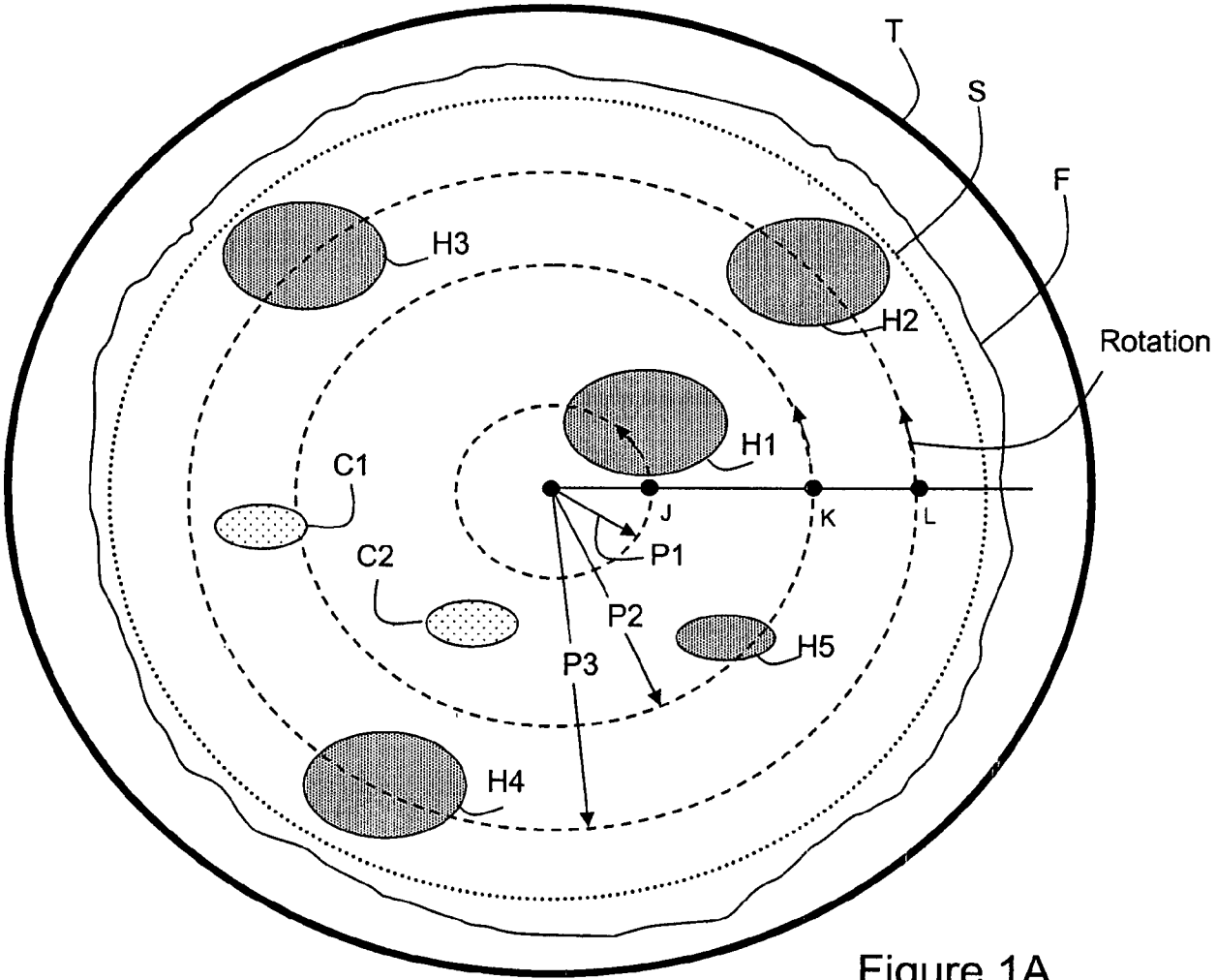
FIG. 1A is a plan view showing regions of differing electric field intensity within a microwave oven and showing the paths followed by three discrete points J, K, and L located at respective radial positions $P_1$, $P_2$ and $P_3$ on a turntable.

Throughout the following detailed description similar reference characters refers to similar elements in all figures of the drawings.

Figure 2:
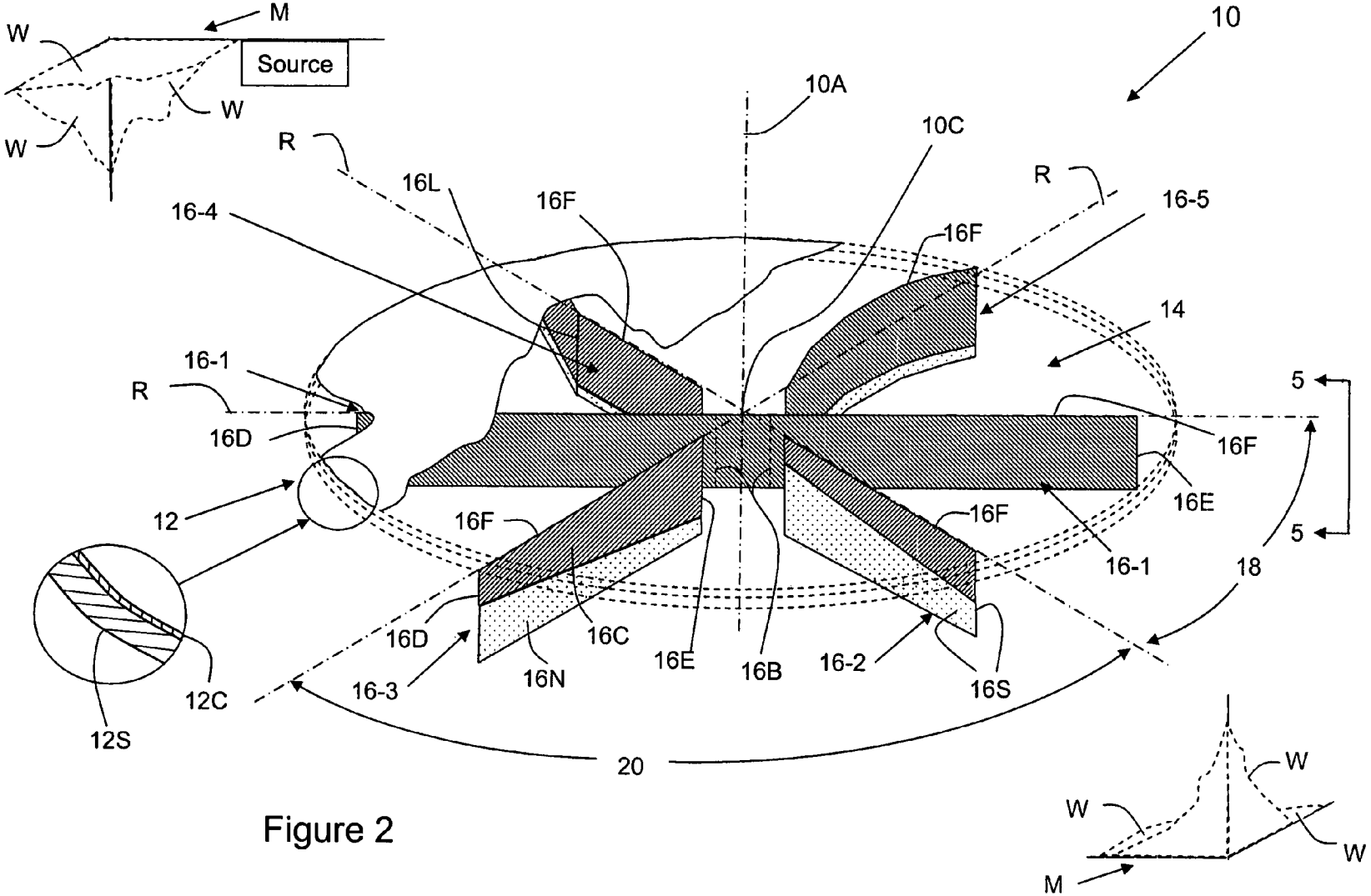
FIG. 2 is a pictorial view of a susceptor assembly with portions of the planar susceptor broken away for clarity and showing various edge shapes of the vanes of the field director structure with the conductive portions of the vanes directly abutting the planar susceptor.
Figure 3:
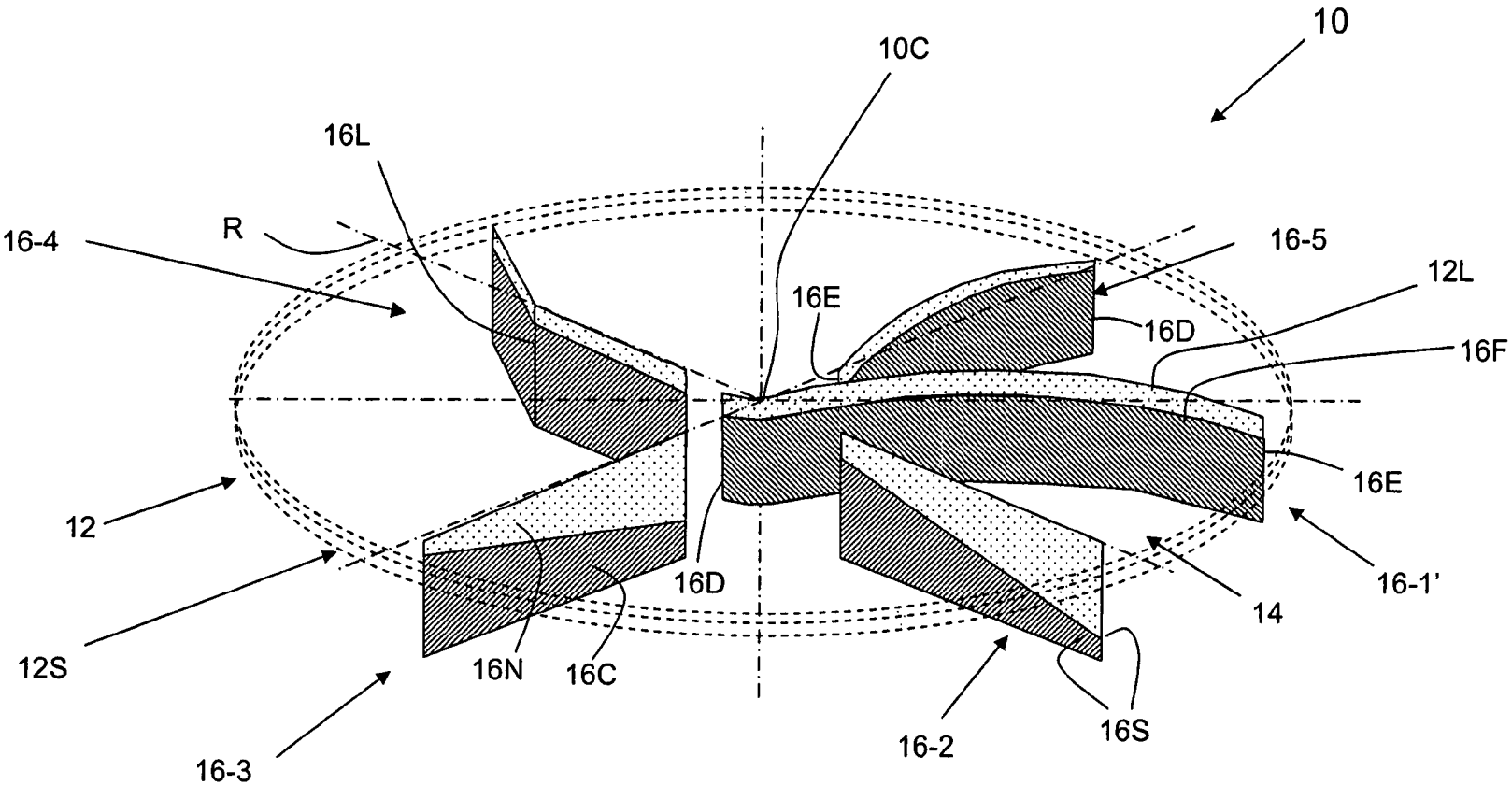
FIG. 3 is a pictorial view similar to FIG. 2 showing the vanes of the field director structure with the conductive portions of the vanes spaced from the planar susceptor.

With reference to FIGS. 2 and 3 shown is a stylized pictorial view of a susceptor assembly generally indicated by the reference numeral 10 in accordance with the present invention. The susceptor assembly 10 has a reference axis 10A extending through its geometric center 10C. The susceptor assembly 10 is, in use, disposed within the resonant cavity on the interior of a microwave oven M. The oven M is suggested only in outline form in the Figures. In operation, a source in the oven produces an electromagnetic wave having a predetermined wavelength. A typical microwave oven operates at a frequency of 2450 MHz, producing a wave having a wavelength on the order twelve centimeters (12 cm) (about 4.7 inches). The walls W of the microwave M impose boundary conditions that cause the distribution of electromagnetic field energy within the volume of the oven to vary. This generates a standing wave energy pattern within the volume of the oven.

The susceptor assembly 10 comprises a conventional, generally planar susceptor 12 having a field director structure generally indicated at reference numeral 14 connected thereto. As will be developed herein the field director structure 14 is useful for redirecting and relocating the regions of high and low electric field intensity of the standing wave pattern within the volume of the oven. When used in conjunction with a turntable the positions of the redirected and relocated regions change continuously, further improving the uniformity of warming, cooking or browning of a food product placed on a susceptor assembly 10 that includes the field director structure 16.

In the embodiment shown in FIGS. 2 and 3 the field director structure 14 is disposed under the planar susceptor 12, although it should be appreciated that these relative positions may be reversed. Whatever the respective relative positions of the field director structure 14 and the planar susceptor 12, a food product (not shown) being warmed, cooked or browned or other article is typically placed is contact with the planar susceptor 12.

The planar susceptor 12 shown in the figures is generally circular in outline although it may exhibit any predetermined desired form consistent with the food product to be warmed, cooked or browned within the oven M. As shown in the circled detail portion of FIG. 2 the planar susceptor 12 comprises a substrate 12S having an electrically lossy layer 12C thereon. The layer 12C is typically a thin coating of vacuum deposited aluminum. The planar susceptor 12 has an electrical conductivity in the range of 0.01 to 100 milliSiemens per square.

The substrate 12S may be made from any of a variety of materials conventionally used for this purpose, such as cardboard, paperboard, fiber glass or a polymeric material such as polyethylene terephlate, heat stabilized polyethylene terephlate, polyethylene ester ketone, polyethylene naphthalate, cellophane, polyimides, polyetherimides, polyesterimides, polyarylates, polyamides, polyolefins, polyaramids or polycyclohexylenedimethylene terephthalate. The substrate 12S may be omitted if the electrically lossy layer 12C is self-supporting.

Figure 4A:
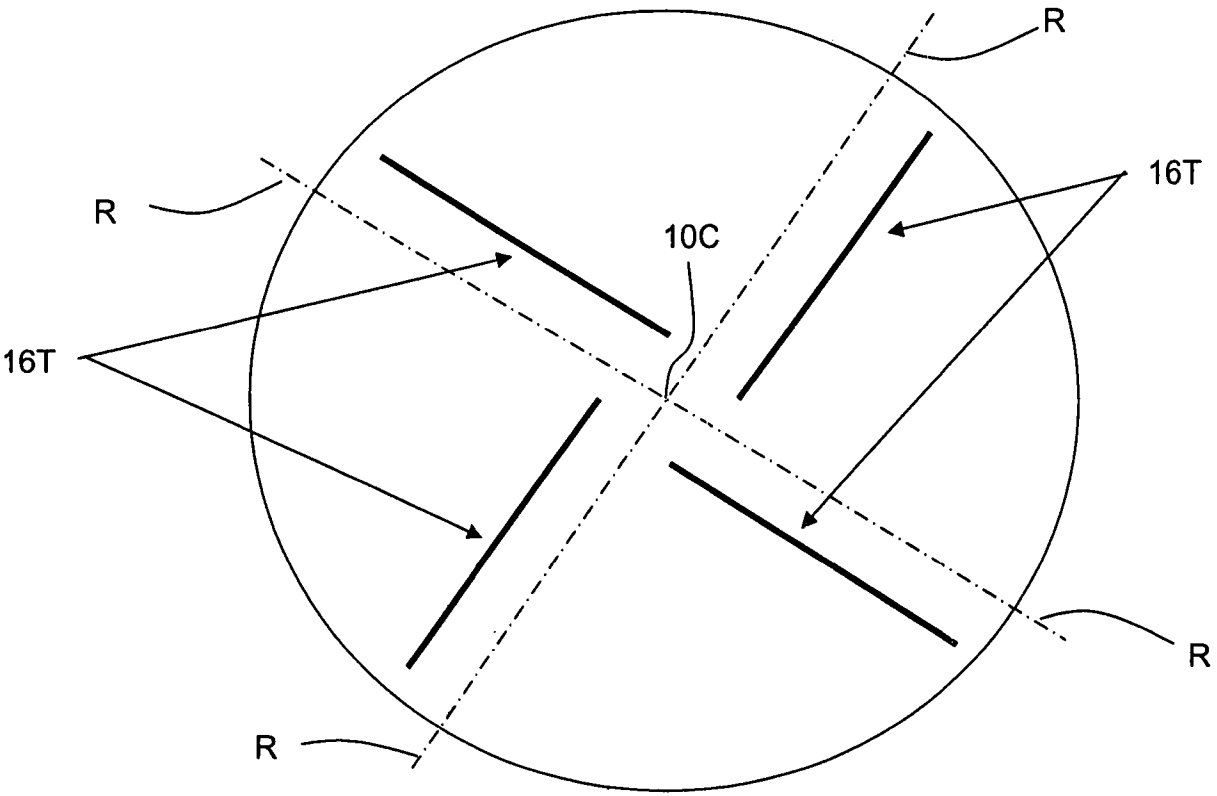
FIGS. 4A through 4C are plan views respectively illustrating generally straight-edged, bent-edged and curved-edged of vanes extending generally transversely across the planar susceptor in directions offset from a generally radial line of the susceptor assembly.

The field director structure 14 includes one or more vanes 16. In the embodiment illustrated in FIGS. 2 and 3, five vanes 16-1 through 16-5 are shown. FIGS. 4A though 4F illustrate susceptor assemblies 10 wherein the field director structure 14 has a number N of vanes 16 ranging from two to six. In general, any convenient number of vanes 1, 2, 3 . . . N may be used, depending upon the size of the planar susceptor, and the edge length, configuration, orientation and disposition of the vanes.

For purposes of illustration the vanes shown in FIGS. 2 and 3 exhibit a variety of edge contours, as will be discussed.

The front and back of each vane define a surface area 16S. In FIGS. 2 and 3 the surface area 16S of each vane 16 is illustrated as generally rectangular, although it should be appreciated that a vane's surface area may be conveniently configured as any plane figure, such as a triangle, a parallelogram or a trapezoid. If desired, the surface area 16S of a vane may be curved in one or more directions.

At least a portion of the surface of the front and/or the back of each of the vane(s) 16 is electrically conductive. Any region of drawing FIGS. 2 and 3 having hatched shading indicates an electrically conductive portion 16C of a vane 16. An electrically non-conductive portion 16N of a vane 16 is indicated by the stipled shading.

Each vane has an edge 16F extending between a first end 16D and a second end 16E. The edge 16F of a vane may exhibit any of a variety of contours. For example, the edge 16F of a vane may be straight, as illustrated by the vanes 16-1 to 16-3. Alternatively, the edge 16F of a vane may be bent or folded along one or more bend or fold line(s) 16L as suggested by the vane 16-4. Moreover, the contour of the edge 16F of a vane may be curved, as suggested by the vanes 16-5 (FIGS. 2 and 3) and the vane 16-1' (FIG. 3).

A vane may have its first end 16D and its second end 16E disposed at any predetermined respective points of origin and termination on the planar susceptor 12. The distance along the edge 16F of a vane between its first end 16D and its second end 16E defines the edge length of the vane. The vanes in the field director structure 14 may have any desired edge length, subject to the proviso regarding the length of the conductive portion 16C mentioned below.

The vanes 16 may be integrally constructed from an electrically conductive foil or other material. In such a case the entire surface 16S of the vane is electrically conductive (e.g., as shown in FIG. 2 for the vane 16-1). The length and width of the conductive portion 16C thus correspond to the edge length and width of the vane.

Alternatively, a vane may be constructed as a layered structure formed from a dielectric substrate with an electrically conductive material laminated or coated over some or all of the front and/or back of its surface area. One form of construction could utilize a paperboard substrate to which an adhesive-backed electrically conductive foil tape is applied.

If provided over less than the full surface area of a vane the electrically conductive portion 16C may itself exhibit any convenient shape, e.g., trapezoidal (as shown for vanes 16-2 and 16-3) or rectangular (as shown for vanes 16-4 and 16-5 and vane 16-1' in FIG. 3). The width dimension of the electrically conductive portion 16C of the vane should be about 0.1 to about 0.5 times the wavelength generated in the oven. The conductive portion 16C of vane has a length that should be at least about a distance approximating about 0.25 times the wavelength of the electromagnetic energy generated in the oven. An edge length about twice the wavelength of the electromagnetic energy generated in the oven defines a practical upper limit.

Whatever the shape of the conductive portion it may be desirable to radius or "round-off" corners to avoid arcing, as will be developed in connection with FIG. 19.

Selection of the shape and the length of the electrically conductive portion of the vane and the spacing of the conductor portion from the susceptor plane and other vanes permits the field attenuating effect of the vane to be more precisely tailored.

Wherever its points of origin and termination a vane may also be arranged to pass through the geometric center 10C. FIG. 2 shows the path of a straight-edged vane 16-1 extending through the geometric center 10C from a first end 16*d* originating adjacent the periphery of the susceptor. FIG. 3 shows the path of a curved-edged vane 16-1' extending through the geometric center 10C from a first end 16D originating in the vicinity of the geometric center 10C. All of the other vanes in FIGS. 2 and 3 have paths that originate at a point of origin in the vicinity of the geometric center 10C and extend outwardly therefrom.

The vanes 16 extend in a generally radial direction with respect to the geometric center 10C of the susceptor assembly 10. The vanes 16 may be angularly spaced about the center 10C at equal or unequal angles of separation. For example, the angle 18 between the vanes 16-1 and 16-2 may be smaller than the angle 20 between the vanes 16-2 and 16-3.

Figure 4B:
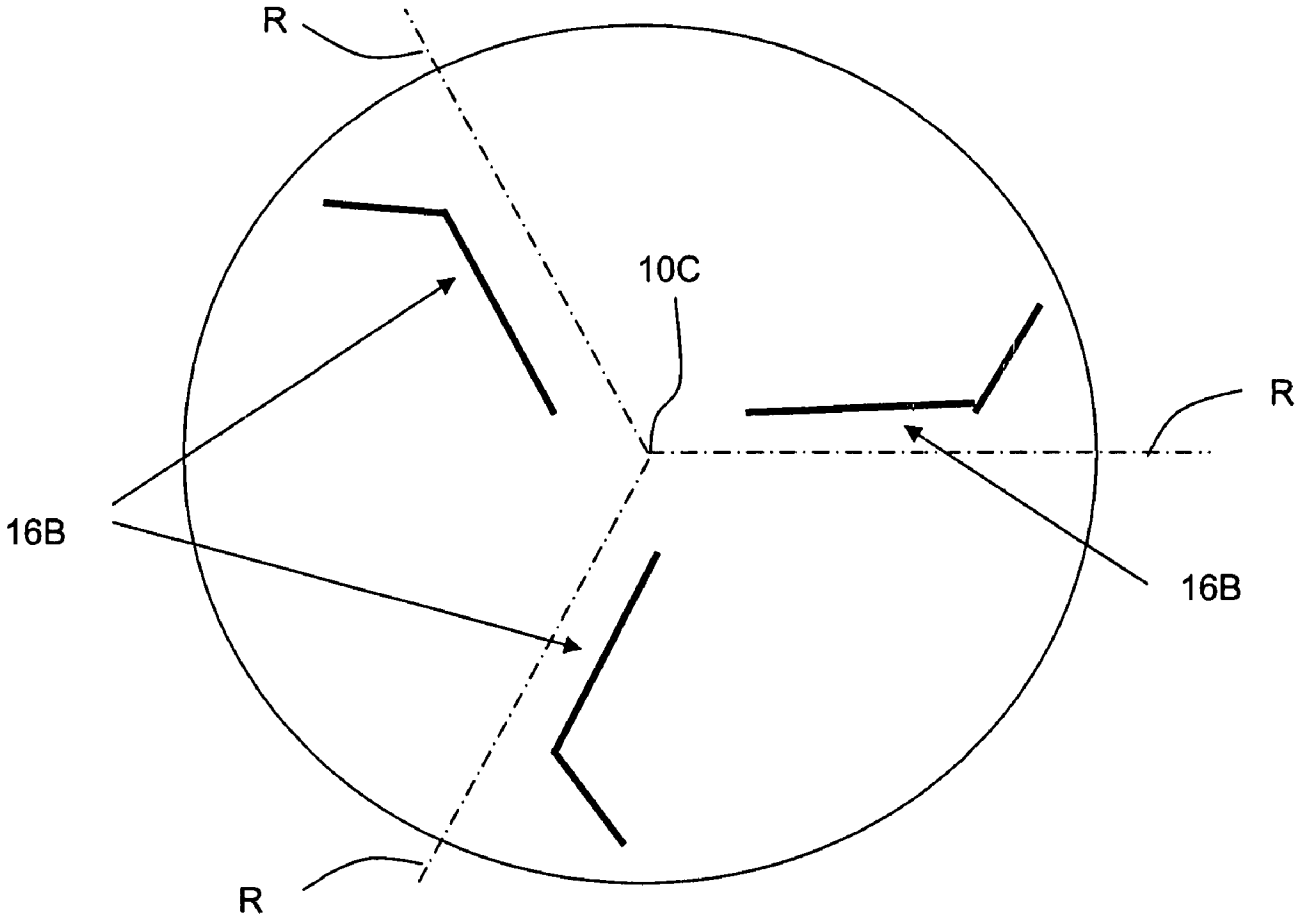
Figure 4C:
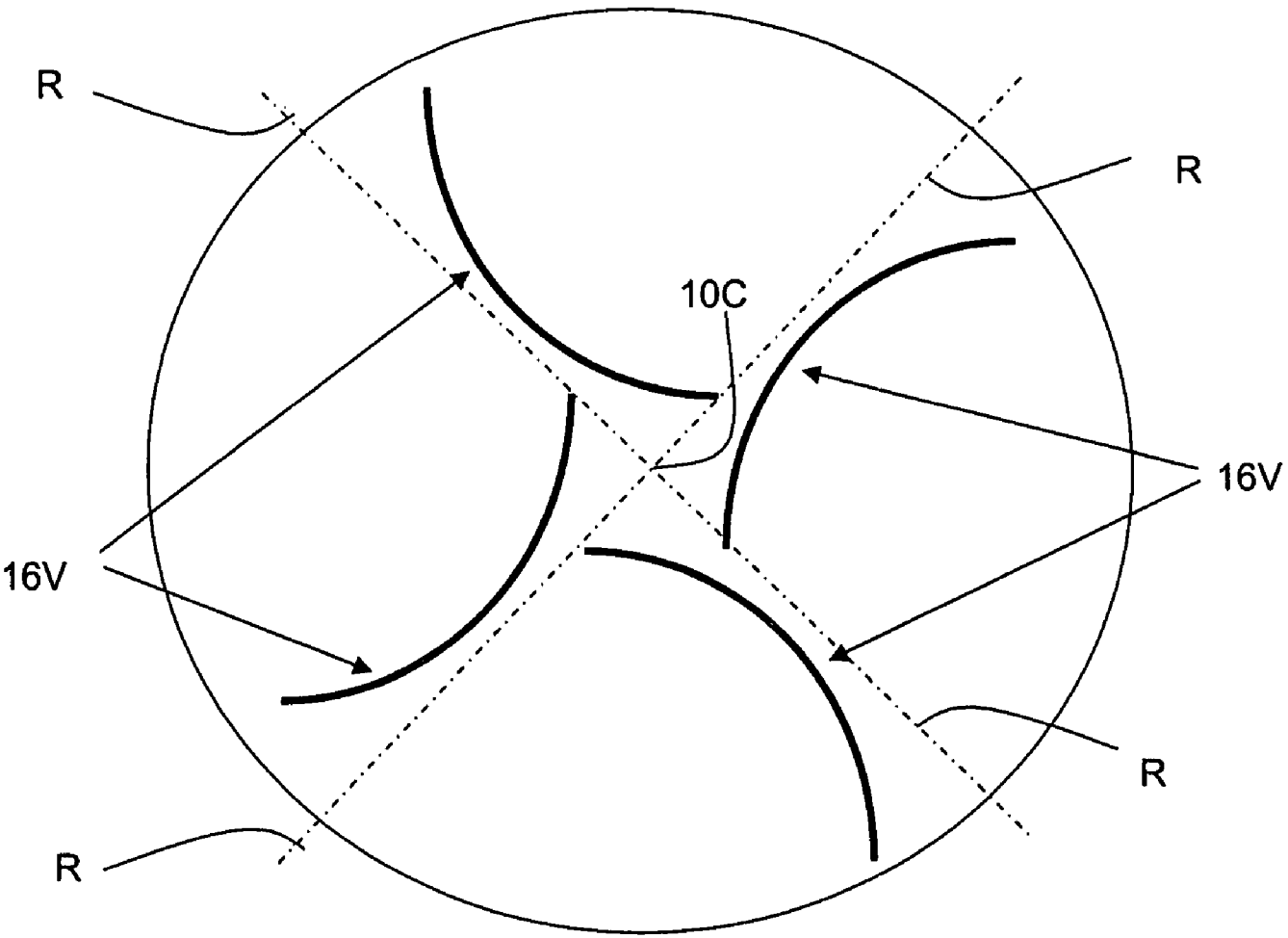
Figure 4D:
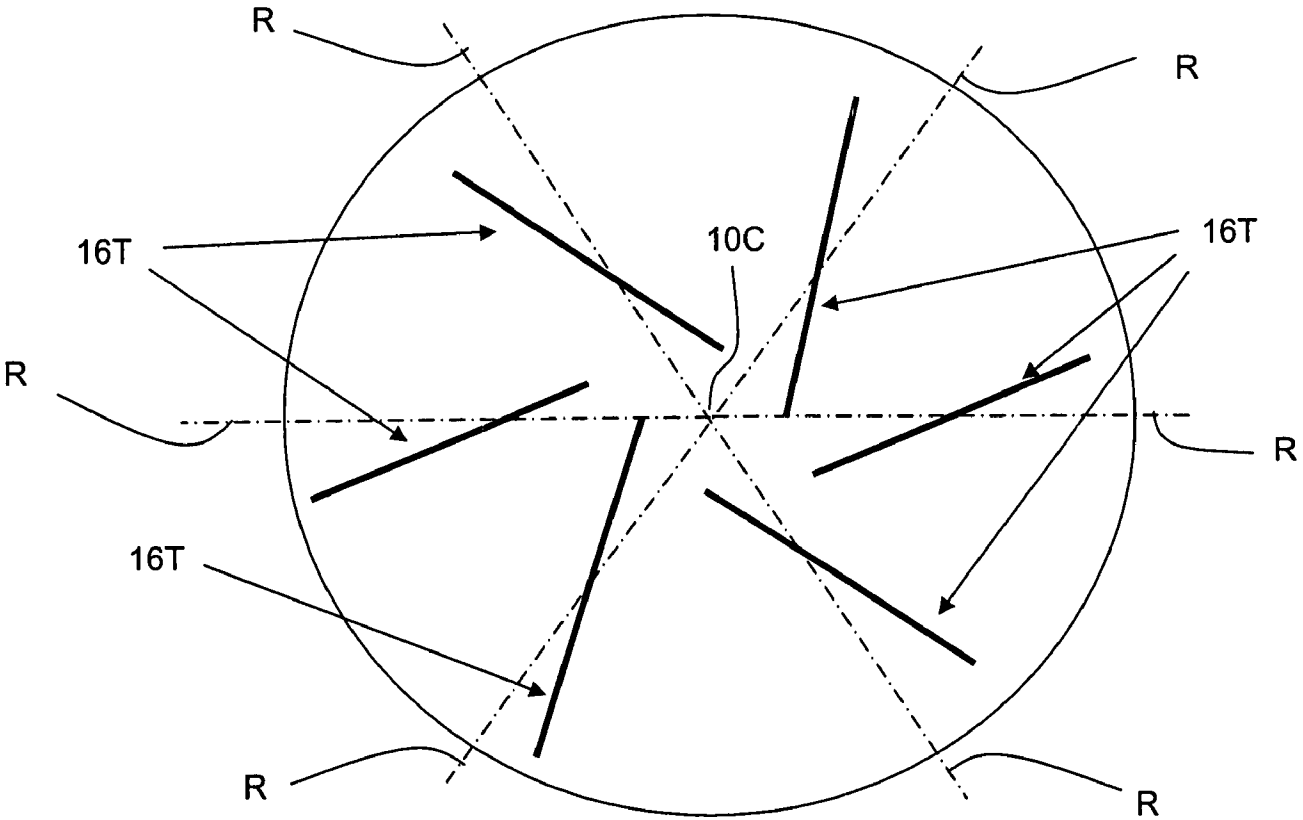
FIGS. 4D through 4F are plan views respectively illustrating generally straight-edged, bent-edged and curved-edged of vanes extending generally transversely across the planar susceptor in a direction that intersects a generally radial line of the susceptor assembly.
Figure 4E:
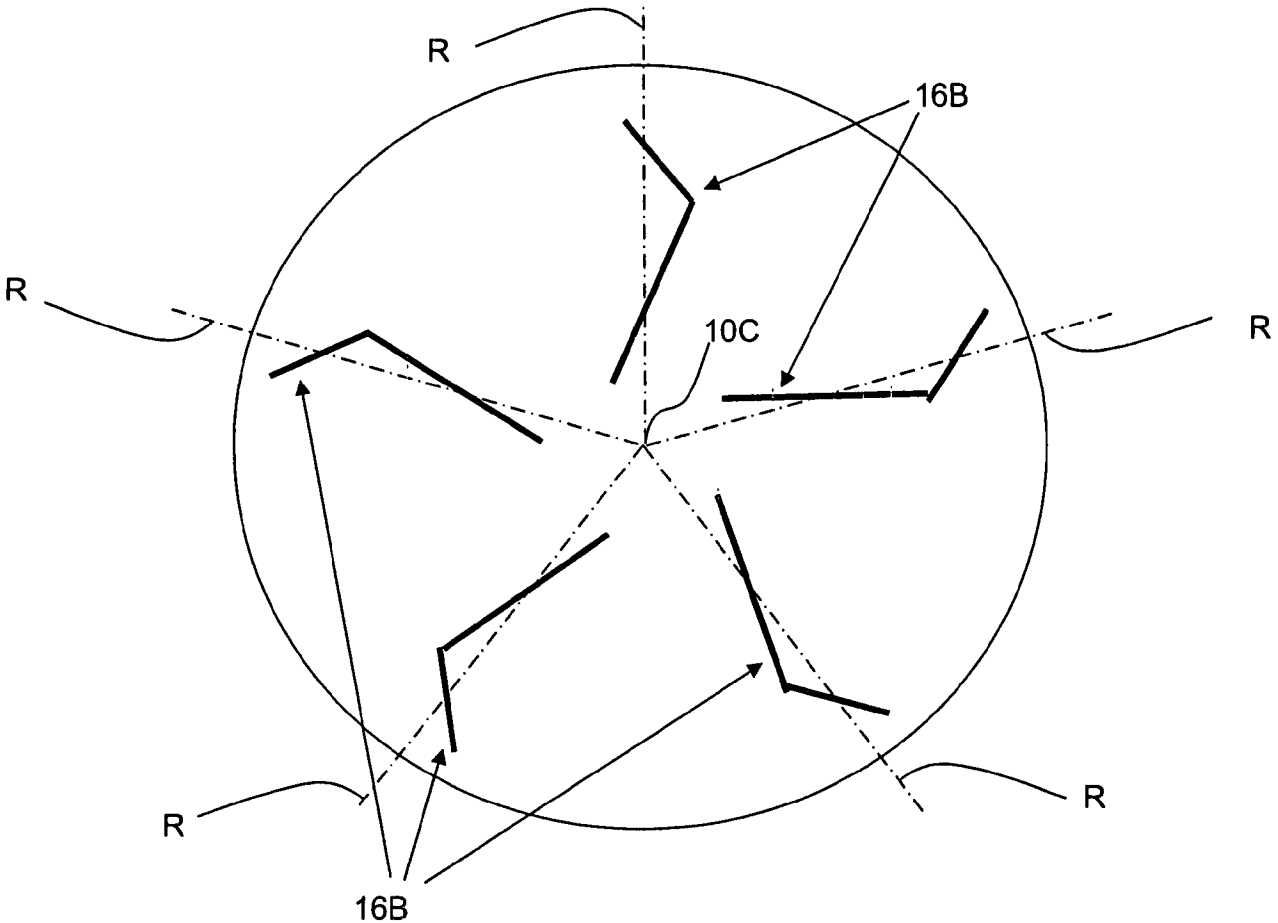
Figure 4F:
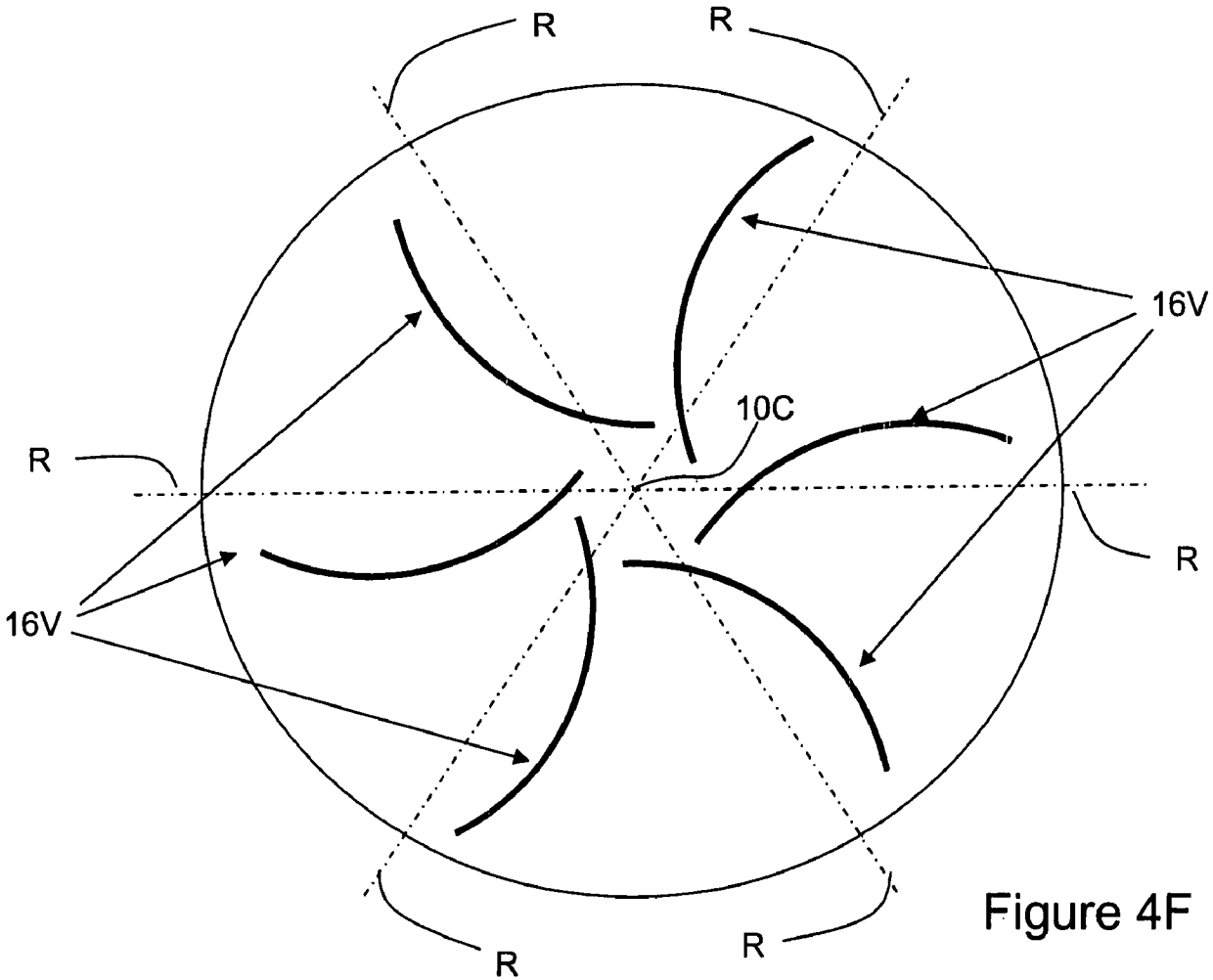

It should be appreciated that the term "generally radial" (or similar terms) does not require that each vane must lie exactly on a radius emanating from the center 10C. For example, vanes may be either offset or inclined with respect to the radius. FIGS. 4A through 4C respectively illustrate straight-edged vanes 16T, bent-edged vanes 16B and curved-edged vanes 16V that are offset with respect to radial lines R emanating from the geometric center 10C. Similarly, FIGS. 4D through 4F respectively illustrate straight-edged vanes 16T, bent-edged vanes 16B and curved-edged vanes 16R that are inclined with respect to radial lines R emanating from the geometric center 10C. Other dispositions of the vanes may be used to achieve the transverse orientation of the vanes 16 with respect to planar susceptor 12.

Each vane 16 is physically (i.e., mechanically) connected to the planar susceptor 12 at one or more connection points. A connection between a vane 16 and the planar susceptor 12 may be a fixed connection or a flexible articulating connection.

Figure 5A:
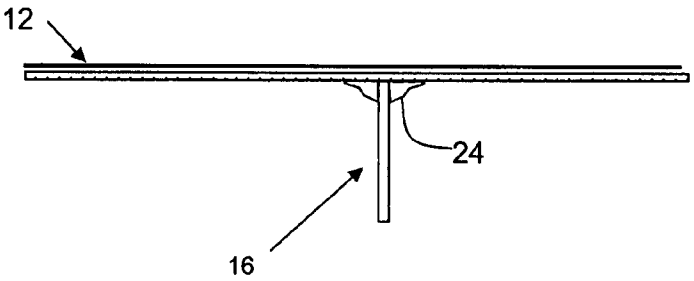
FIGS. 5A and 5B are elevation views taken along view lines 5-5 in FIG. 2 respectively illustrating a vane of the field director having a fixed connection to a planar susceptor and a flexible articulating connection, with the vane in the latter case shown in stored and deployed positions.

A fixed connection is shown in FIG. 5A. In a fixed connection a vane 16 is attached by a suitable adhesive 24 in a predetermined fixed orientation with respect to the planar susceptor 12. The orientation of the vane 16 is preferably at an angle of inclination in the range between about forty-five degrees (45°) and about ninety degrees (90°) degrees with respect to the planar susceptor, although smaller angular orientations may provide a useful effect. In the most preferred instance the vane 16 is substantially orthogonal to the planar susceptor 12.

Figure 5B:
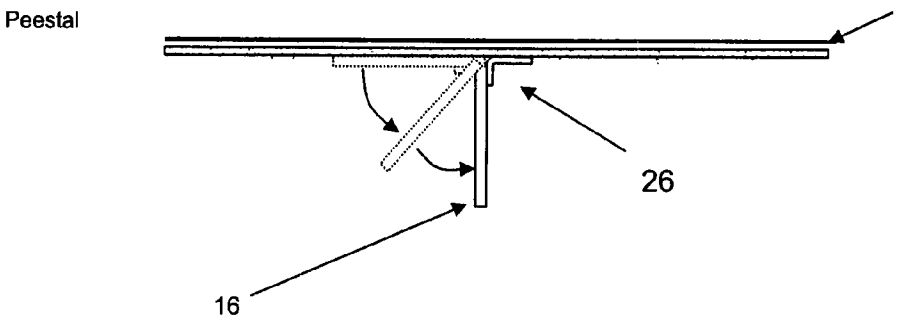

A flexible articulating connection is shown in FIG. 5B. In this arrangement a vane 16 is attached to the planar susceptor 12 by a hinge 26. The hinge may be made from a flexible tape. In an articulating connection the vane 16 is movable from a stored position (shown in dashed lines in FIG. 5B) in which the plane of the vane is substantially parallel to the planar susceptor to a deployed position (shown in solid outline lines in FIG. 5B). The hinge may be provided with a suitable stop so that, in the deployed position, the vane is held at a desired angle of inclination, preferably in the range between about forty-five degrees (45°) and about ninety degrees (90°) degrees with respect to the planar susceptor, and most preferably substantially orthogonal to the planar susceptor 12.

Whatever the form of construction, configuration of the vane's surface area, shape of the conductive portion, edge contour of the vane, edge length of the vane, length of the conductive portion on the vane, path of the vane with respect to the center of the susceptor, and the orientation of the vane with respect to plane of the susceptor, the electrically conductive portion 16C of the vane 16 must be disposed no farther than a predetermined close distance from the electrically lossy layer 12C of the planar susceptor 12. In general the predetermined close distance should be no greater than a distance approximating 0.25 times the wavelength of the electromagnetic energy generated in the oven. It should be understood that so long as a food product or other article is present the predetermined close distance can be zero, meaning that the conductive portion 16C of the vane abuts electrically against the lossy layer 12C of the planar susceptor.

In a typical implementation, shown in FIG. 2, the lossy layer 12C is supported on a dielectric substrate 12S, so that the edge of the conductive portion 16C of the vane is spaced from the lossy layer 12C by only the thickness of the substrate 12S. The vertical dimension of the non-conductive portions 16N may be used to control the height at which the planar susceptor 12 is supported within the oven M.

Alternatively, as seen from FIG. 3 the non-conductive portions 12N of the vanes may be disposed adjacent to the planar susceptor 12. This disposition has the effect of spacing the conductive portions 16C of the vanes away from the lossy layer 12C at distances greater than the thickness of the substrate 12S. If desired, additional non-conductive portions 16N may be disposed along the opposite edge of the vanes to obtain the height control benefits discussed above.

The planar susceptor 12 and a surface area 16S of a vane 16 intersect along a line of intersection 12L extending in a generally transverse direction with respect to the planar susceptor 12. When intersected with the planar susceptor 12, a straight-edged vane 16 will produce a straight line of intersection 12L. A vane 16 having a bent edge or curved edge, when intersected with the planar susceptor 12, will produce a bent or curved line of intersection 12L, respectively. The magnitude of the bend angle or the shape of curvature of the line of intersection, as the case may be, will depend upon the angle of inclination of the vane to the planar susceptor. Whether the line of intersection is a straight line, a bent line or a curved line, the extension of the conductive surface of the vane will lie along the line of intersection.

Having described the various structural details of a susceptor assembly 10 in accordance with the present invention, its effect on a standing electromagnetic wave may now be discussed.

Figure 6:
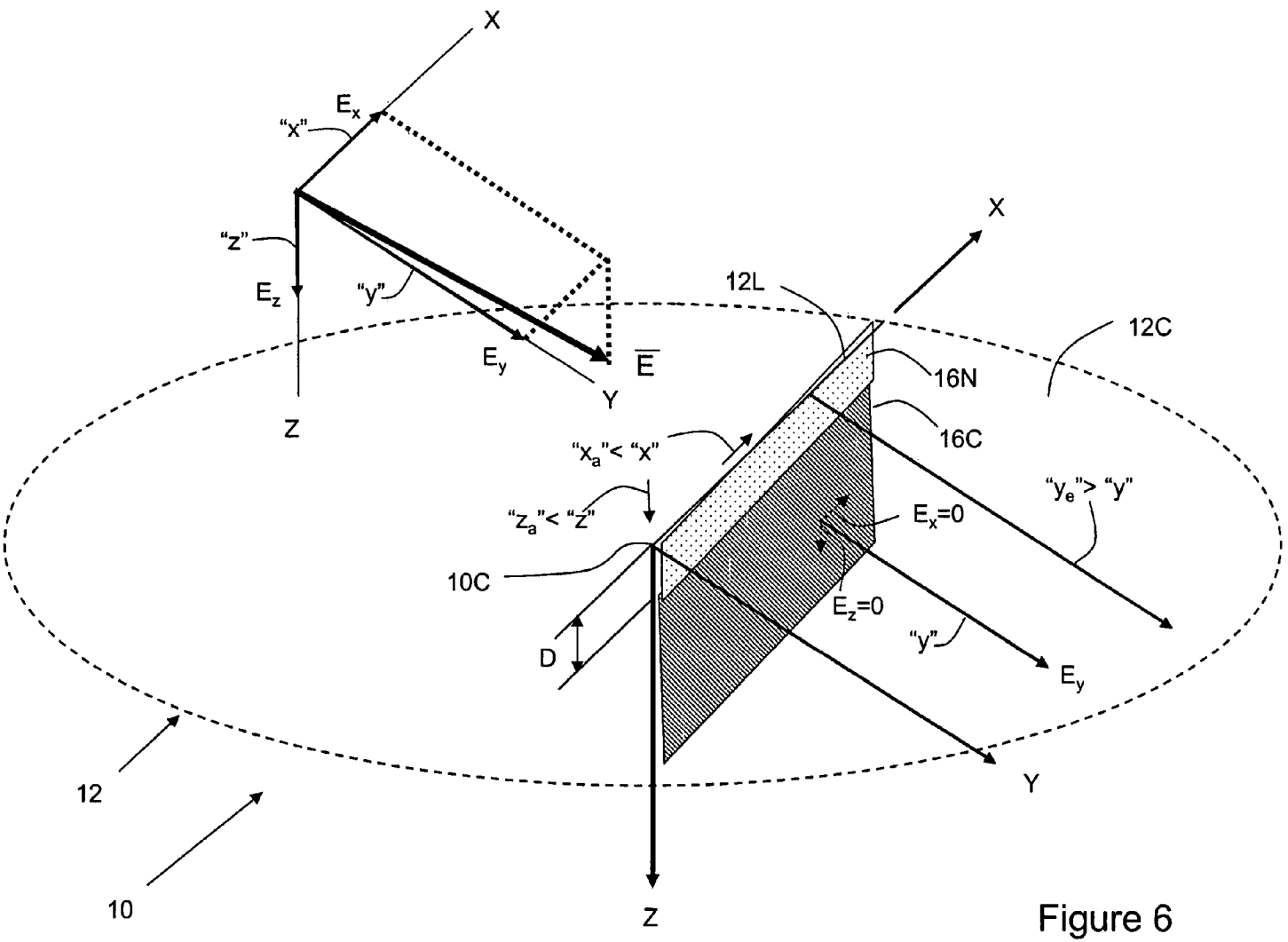
FIG. 6 is a pictorial view illustrating the attenuating effect of a single transverse electrically conductive vane on the constituent field vectors of the electric field component in the plane of the planar susceptor.

FIG. 6 is a schematic diagram representation in which an embodiment of a susceptor assembly 10 having a single straight-edged vane 16 is connected in a substantially orthogonal orientation with respect to the undersurface of a planar susceptor 12. A set of Cartesian axes is positioned to originate at the geometric center 10C of the assembly 10. The assembly 10 is arranged so that the planar susceptor 12 lies in the X-Y Cartesian plane and that the conductive portion 16C of the surface 16S of the vane 16 lies in the X-Z Cartesian plane. The line of intersection 12L defined along the connection between the vane 16 and the planar susceptor 12 extends transversely across the lossy layer 12C of the planar susceptor 12 and is oriented along the X axis, as illustrated. The conductive portion 16C of the surface 16S of the vane 16 lies a predetermined distance D in the Z direction from the lossy layer on the planar susceptor 12. The conductive portion 16C of the surface 16S has a thickness (i.e., it's Y dimension) greater than the depth of the skin effect of a conductor at the frequency of microwave operation.

An electromagnetic wave is composed of mutually orthogonal oscillating magnetic and electric fields. At any given instant a standing electromagnetic wave includes an electric field constituent $\overline{E}$. At any instant the electric field constituent $\overline{E}$ is oriented in a given direction in the Cartesian space and may have any given value.

The electric field $\overline{E}$ is itself resolvable into three component vectors, viz., $\overline{E}_x$, $\overline{E}_y$, $\overline{E}_z$. Each component vector is oriented along its respective corresponding coordinate axis. Depending upon the value of the electric field $\overline{E}$ each component vector has a predetermined value of "x", "y" or "z" units, as the case may be.

One corollary of Faraday's Law of Electromagnetism is the boundary condition that the tangential electric field at the interface surface between two media must be continuous across that surface. A particular example of such a media interface is that between a perfect conductor and air. By definition, a perfect conductor must have a zero electric field within it. Therefore, in particular, the tangential component of the electric field just inside the conductor surface must be zero. Hence, from the above asserted boundary continuity condition, the tangential electric field in the air just outside the conductor must also be zero. So we have the general rule that the tangential component of the electric field at the surface of a perfect conductor is always zero. If the conductor is good, but not perfect, then the tangential component of the electric field at the surface may be nonzero, but it remains very small. Thus, any electric field existing just outside the surface of a good conductor must be substantially normal to that surface.

The application of this physical law mandates that within that surface area of the vane 16 having the conductive portion 16C only the component vector of the electric field that is oriented perpendicular to that surface, viz., the vector $\overline{E}_y$, is permitted to exist.

The component vectors of the electric field lying in any plane tangent to the surface of the vane, (viz., the vector $\overline{E}_x$ and the vector $\overline{E}_z$) are not permitted. In FIG. 6, the tangent plane is the plane of the conductive portion of the surface of the vane.

If the conductive portion 16C of the vane 16 were in electrical contact with the lossy layer 12C the value of the component vector $\overline{E}_x$ lying along the line of intersection 12L and the value of the component vector $\overline{E}_z$ would be zero, for the reasons just discussed. However, the conductive portion 16C is not in electrical contact with the lossy layer 12C, but is instead spaced therefrom by the distance D. The conductive portion of the surface of the vane nevertheless exerts an attenuating effect having its most pronounced action in the extension of the conductive portion of the surface of the vane.

Thus, the component vectors $\overline{E}_x$ and $\overline{E}_z$ of the electric field of the wave have only attenuated intensities "$x_a$" and "$z_a$". The intensity values "$x_a$" and "$z_a$" are each some intensity value less than "x" and "z", respectively. Attenuation of the electric field component of the electromagnetic wave in the plane tangent to the surface of the vane results in enhancement of the component of the electric field oriented perpendicular to the conductive portion of the surface of the vane. Thus, the component vector $\overline{E}_y$ has an enhanced intensity value "$y_e$" greater than the intensity value than "y".

The degree of attenuation of the vector component $\overline{E}_x$ is dependent upon the magnitude of the distance D and the orientation of the conductive portion 16C relative to the lossy layer 12C. The attenuation effect is most pronounced when the distance D is less than one-quarter (0.25) wavelength, for a typical microwave oven a distance of about three centimeters (3 cm). At an angle of inclination less than ninety degrees the permitted field (i.e., the field normal to the conductive surface of the vane) will itself have components acting in the susceptor plane.

This effect is utilized by the susceptor assembly 10 of the present invention to redirect and relocate the regions of relatively high electric field intensity within a microwave oven.

Figure 7A:
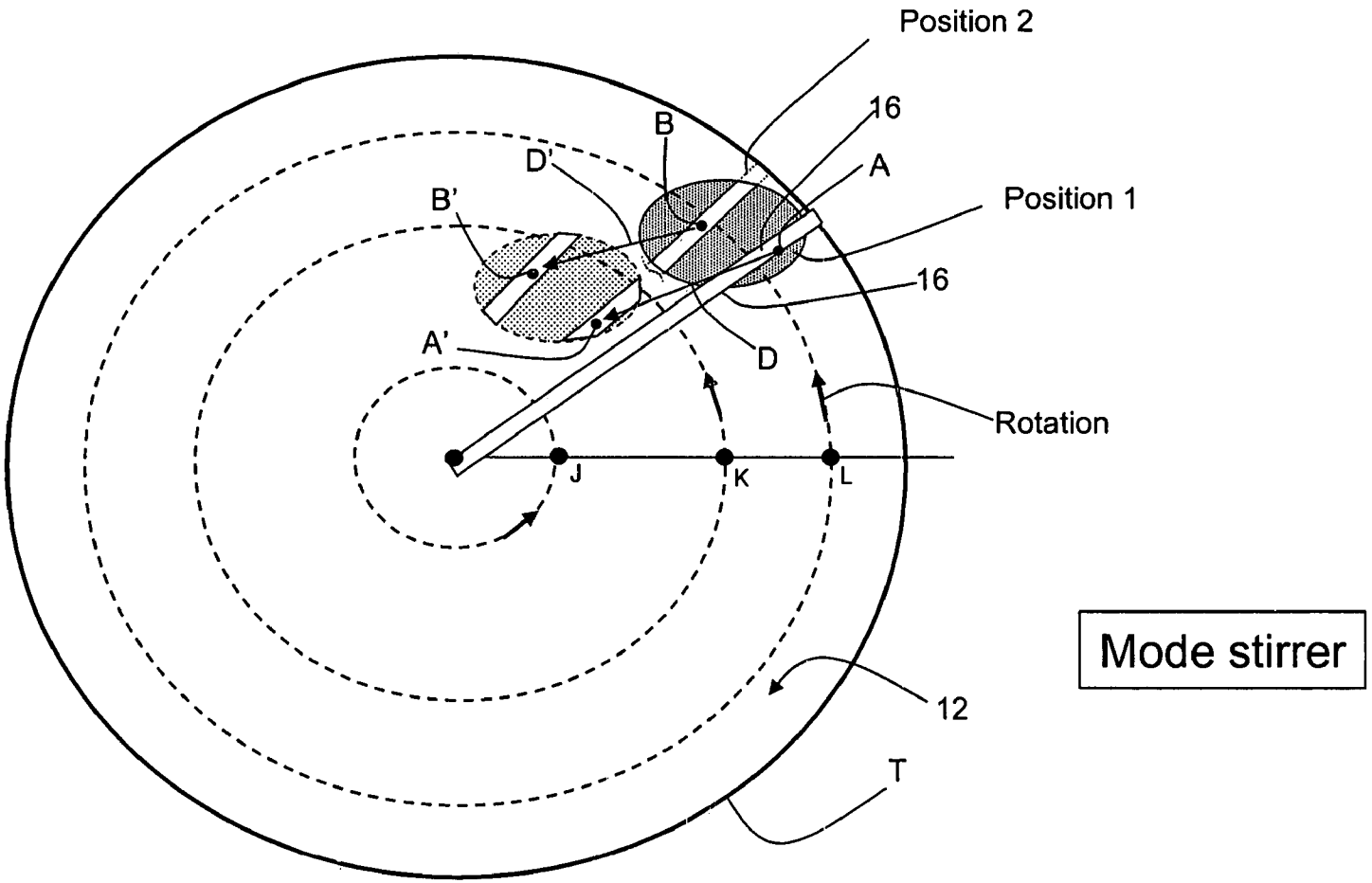
FIG. 7A is a plan view, generally similar to FIG. 1A, showing the effect of the field director structure of a susceptor assembly of the present invention upon regions of high electric field intensity and again showing the paths followed by three discrete points J, K, and L located at respective radial positions $P_1$, $P_2$ and $P_3$ on a turntable.

FIG. 7A is a stylized plan view, generally similar to FIG. 1A, illustrating the effect of a vane 16 as it is carried by a turntable T in the direction of rotation shown by the arrow. The vane is shown in outline form and its thickness is exaggerated for clarity of explanation.

Consider the situation at Position 1, near where the vane first encounters the hot region $H_2$. For the reasons explained earlier only an electric field vector having an attenuated intensity is permitted to exist in the segment of the hot region $H_2$ overlaid by the vane 16. However, even though only an attenuated field is permitted to exist the energy content of the electric field cannot merely disappear. Instead, the attenuating action in the region extending from the conductive portion of the vane manifests itself by causing the electric field energy to relocate from its original location A on the planar susceptor 12 to a displaced location A'. This energy relocation is illustrated by the displacement arrow D.

As the rotational sweep carries the vane 16 to Position 2 a similar result obtains. The attenuating action of the vane again permits only an attenuated field to exist in the region extending from the conductive portion of the vane. The energy in the electric field energy originally located at location B on the planar susceptor 12 displaces to location B', as suggested by the displacement arrow D'.

Similar energy relocations and redirections occur as the vane 16 sweeps through all of the regions $H_1$ through $H_5$ (FIG. 1A) of relatively high electric field intensity.

The use of the present invention in a microwave oven having a mode stirrer apparatus will result in the same effect.

Figure 1B:
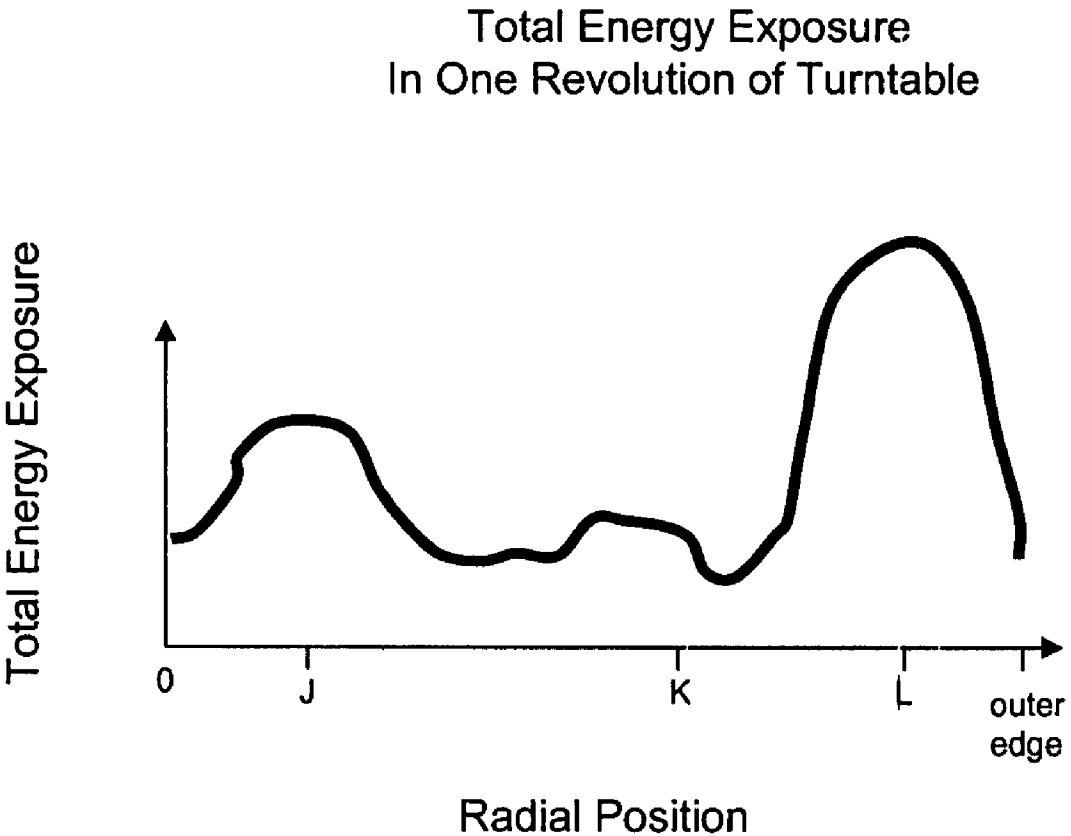
FIG. 1B is a plot showing total energy exposure for one full rotation of the turntable at each of the discrete points identified in FIG. 1A.
Figure 7B:
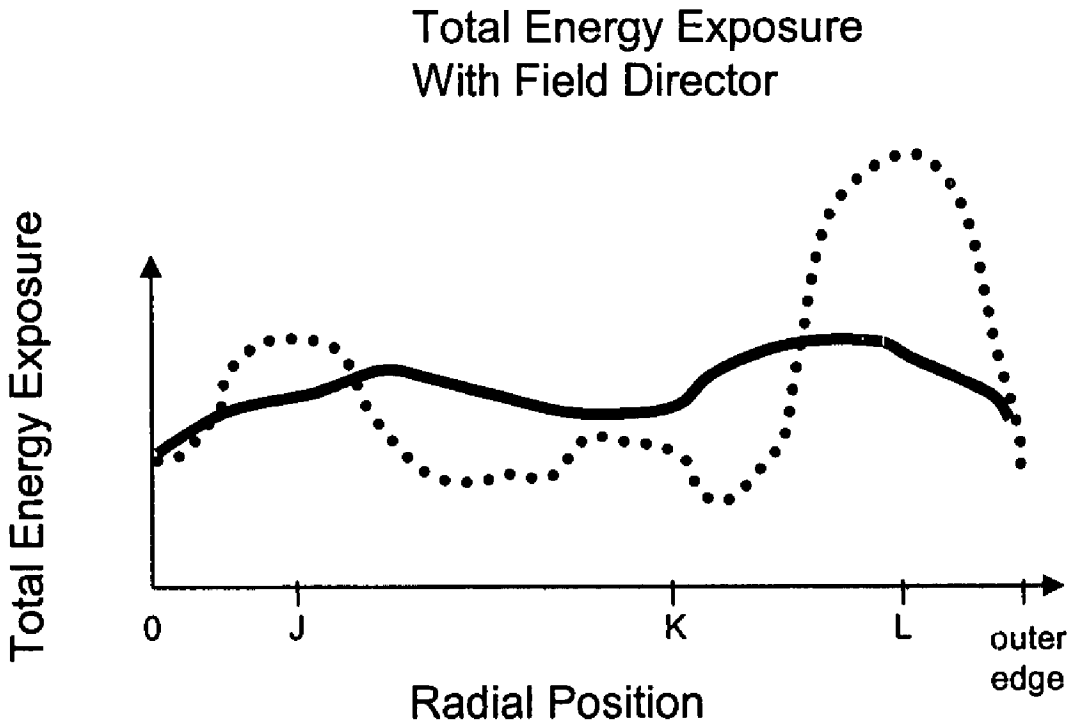
FIG. 7B is a plot, similar to FIG. 1B, showing total energy exposure for one full rotation of the turntable at each discrete point, with the waveform of FIG. 1B superimposed for ease of comparison.

FIG. 7B is a plot showing total energy exposure for one full rotation of the turntable at each discrete point J, K and L. The corresponding waveform of the plot of FIG. 1B is superimposed thereover.

It is clear from FIG. 7B that the presence of a susceptor assembly 10 having the field director 14 in accordance with the present invention results in a total energy exposure that is substantially uniform. As a result, warming, cooking and browning of a food product placed on the susceptor assembly 10 will be improved over the situation extant in the prior art.

FIGS. 8A and 8B, 9A and 9B and 10A and 10B illustrate preferred constructions of a susceptor assembly in accordance with the present invention.

Figure 8A:
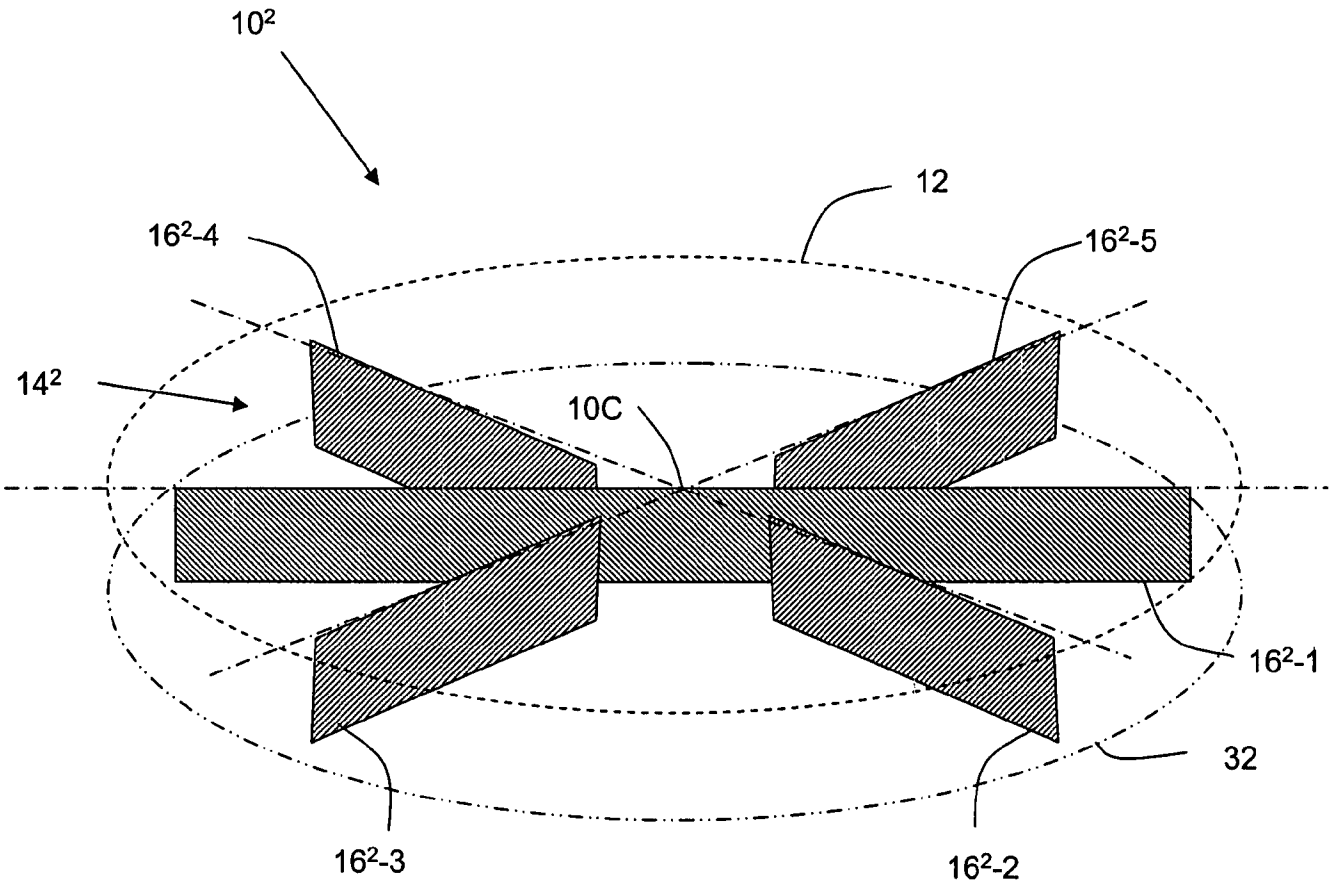
FIGS. 8A, 9A and 10A are pictorial views of various preferred implementations of a susceptor assembly in accordance with the invention, with portions of the planar susceptor broken away for clarity.
Figure 8B:
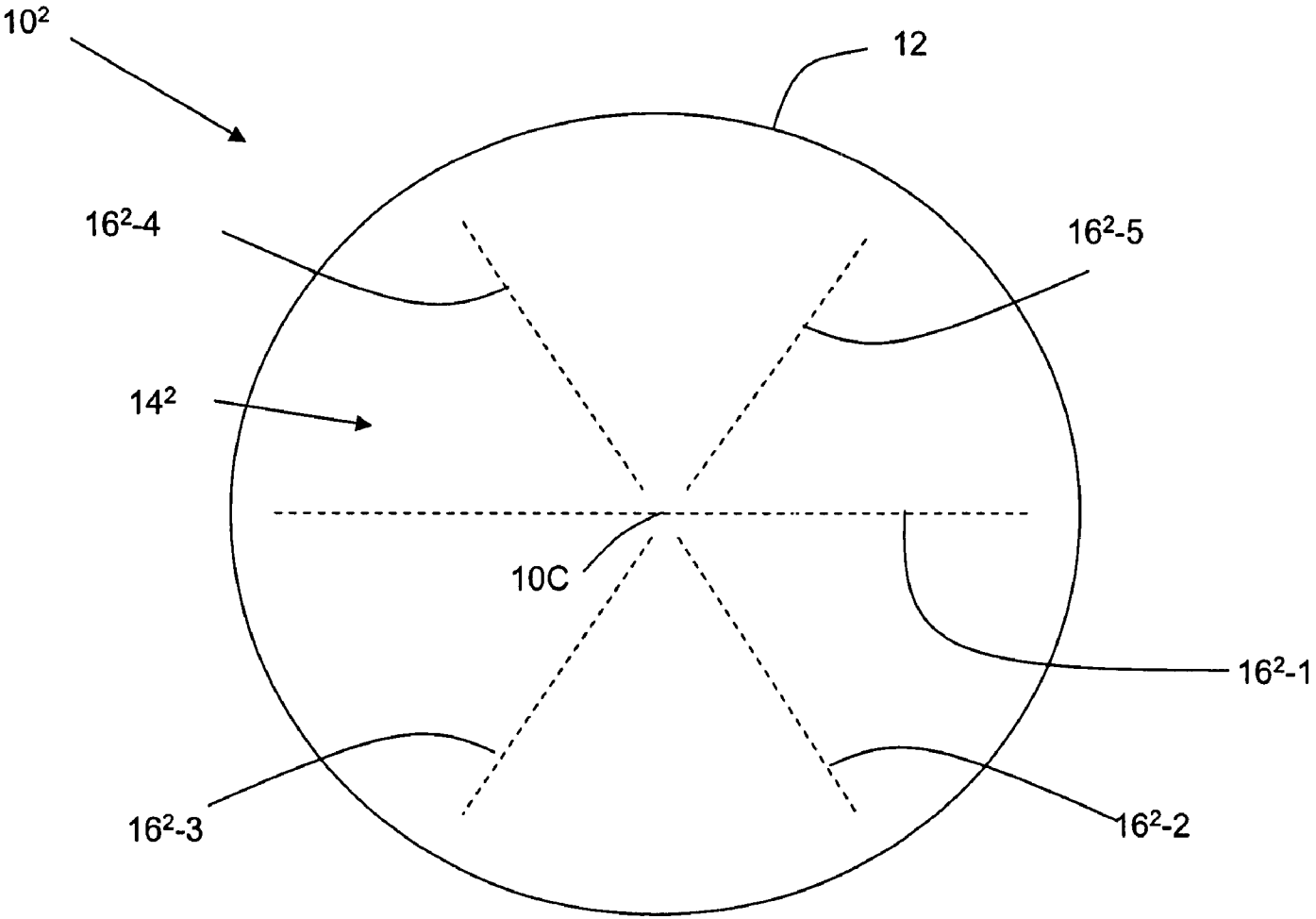
FIGS. 8B, 9B and 10B are plan views of the susceptor assembly shown in FIGS. 8A, 9A and 10A, respectively.

FIGS. 8A and 8B show a susceptor assembly $\mathbf{10}^2$ that includes a field director structure $\mathbf{14}^2$ having five straight-edged vanes $\mathbf{16}^2$-1 through $\mathbf{16}^2$-5. The five vanes $\mathbf{16}^2$-1 through $\mathbf{16}^2$-5 are attached to the underside of a planar susceptor 12. The vanes lie substantially orthogonal to the planar susceptor 12 and are equiangularly arranged about the center 10C. The vane $16^2$-1 extends through the center 10C while the vanes $16^2$-2 through $16^2$-5 originate in the vicinity of the center 10C. The conductive portion $16^2$C covers the entire surface of each vane. If desired the bottom edges of vanes of the field director $14^2$ may be further supported on a non-conductive planar support member 32.

The support member may be connected to all or some of the vanes.

Figure 9A:
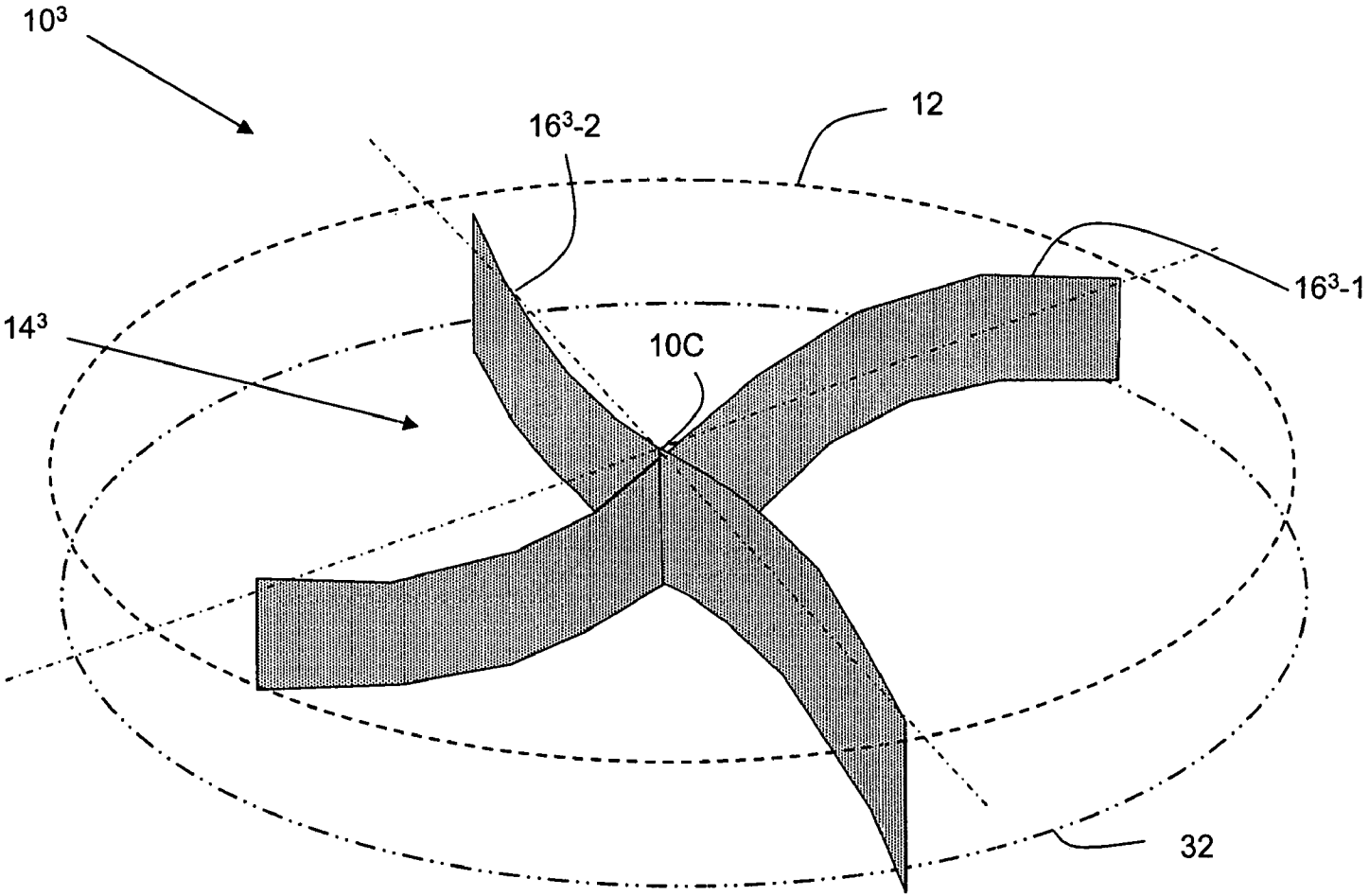
Figure 9B:
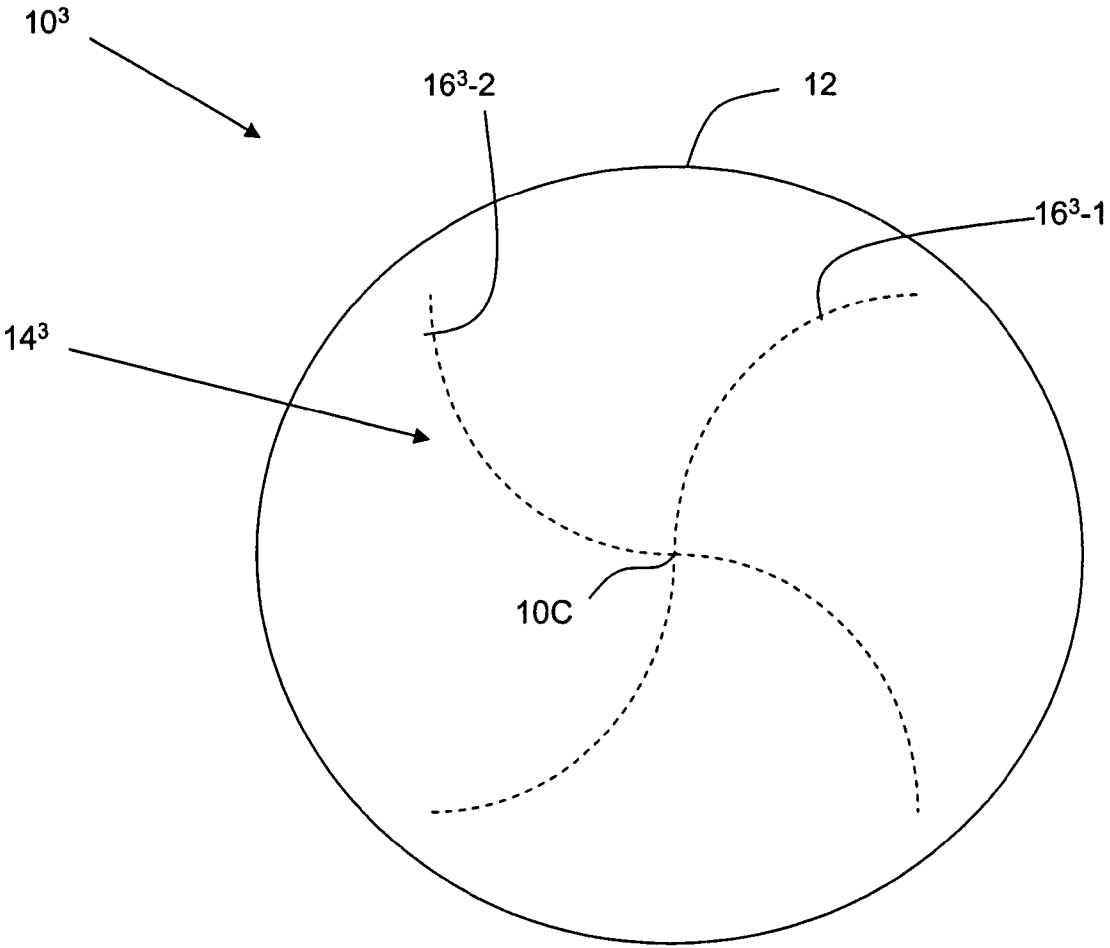

FIGS. 9A and 9B show a susceptor assembly $10^3$ that includes a field director structure $14^3$ having two curved-edged vanes $16^3$-1 and $16^3$-2. The two vanes $16^3$-1 and $16^3$-2 are attached to the underside of a planar susceptor 12. The vanes lie substantially orthogonal to the planar susceptor 12 and are equiangularly arranged about the center 10C. The vanes intersect each other in the vicinity of the center 10C. The conductive portion $16^3$C covers the entire surface of each vane. Again, a non-conductive planar support member 32 may be further support the bottom edges of vanes of the field director $14^3$, if desired.

Figure 10A:
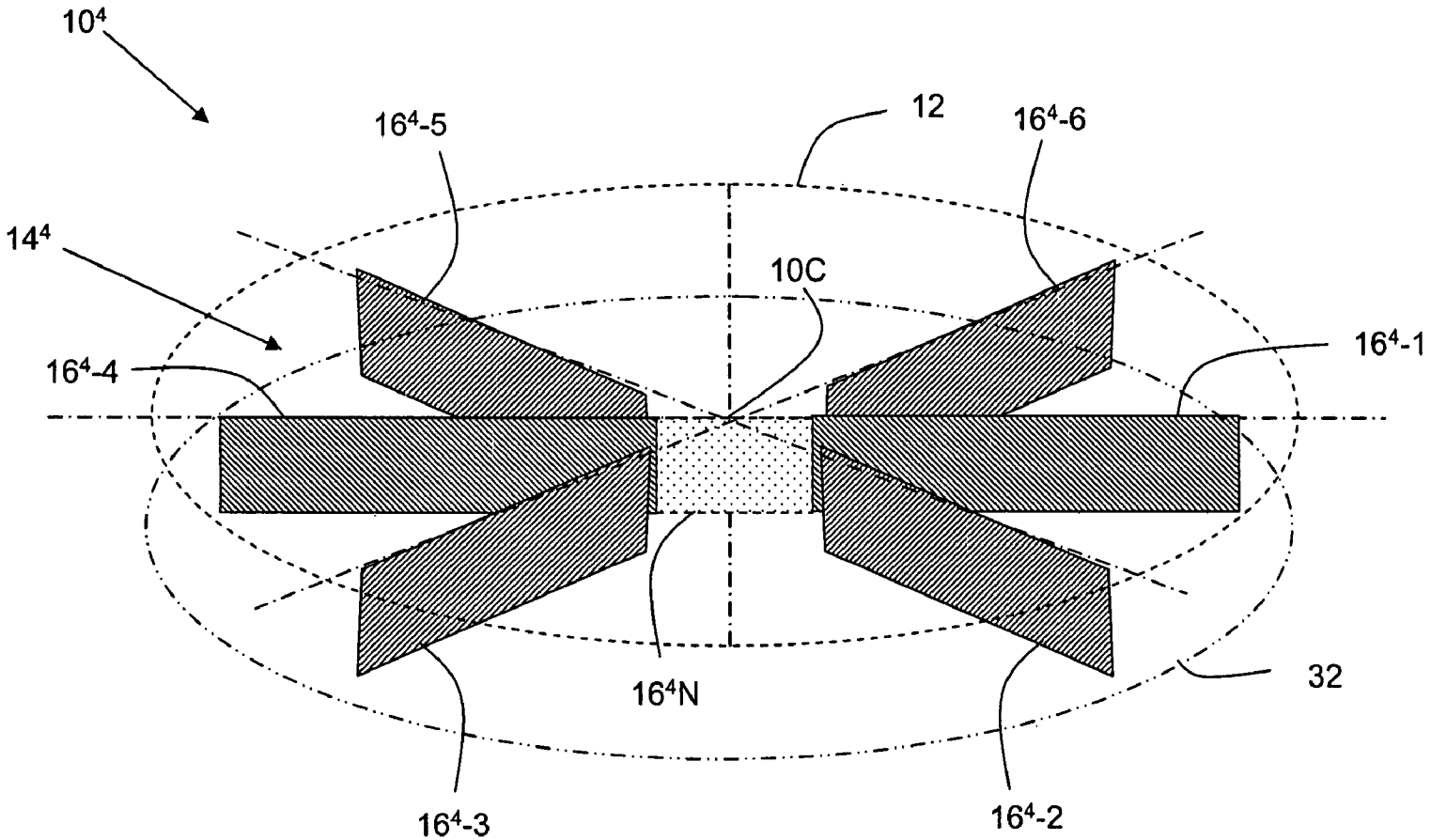
Figure 10B:
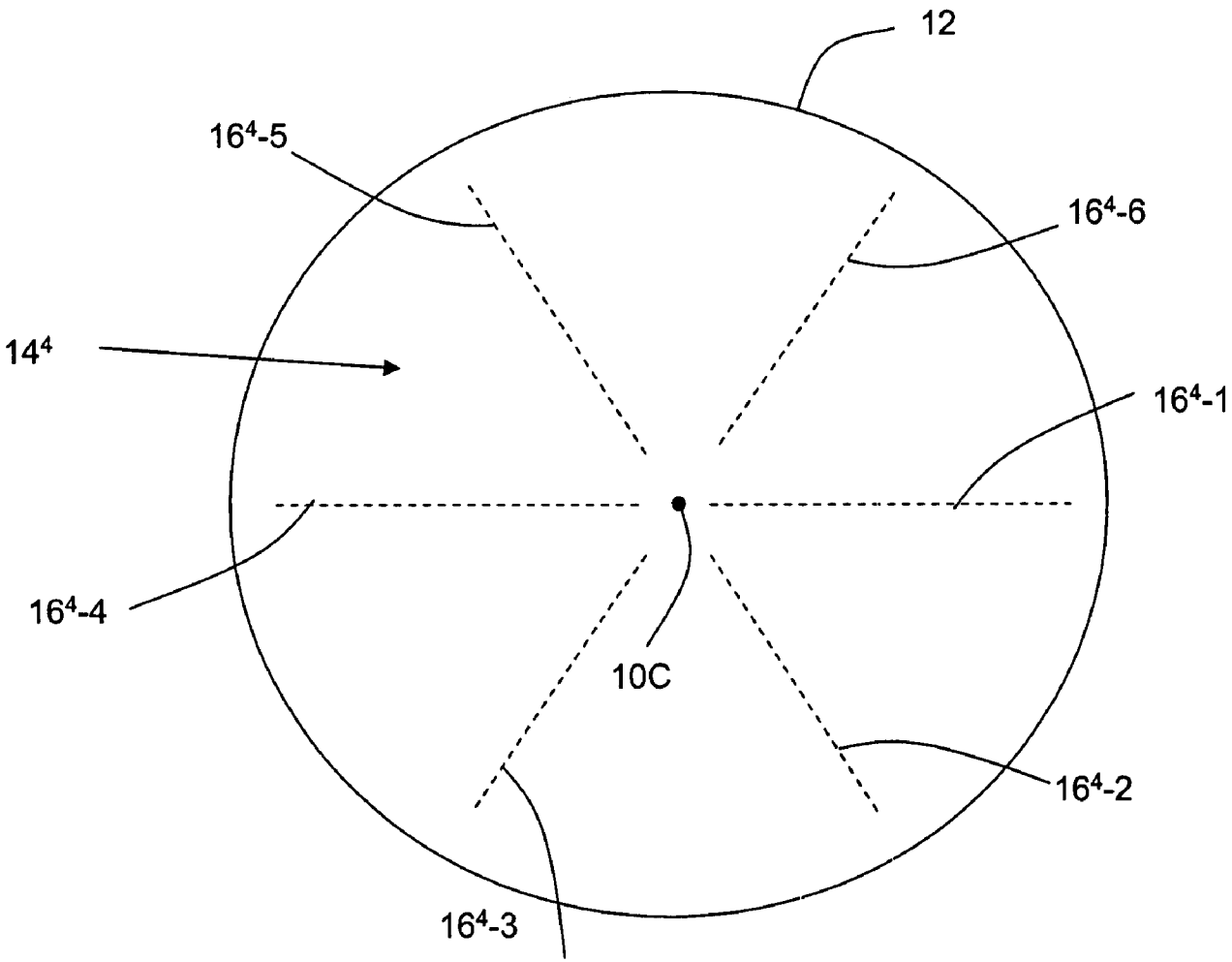

FIGS. 10A and 10B show a susceptor assembly $10^4$ that includes a field director structure $14^4$ having six straight-edged vanes $16^4$-1 through $16^4$-6. The six vanes $16^4$-1 through $16^4$-6 are attached to the underside of a planar susceptor 12. The vanes lie substantially orthogonal to the planar susceptor 12 and are equiangularly arranged about the center 10C. All of the vanes originate in the vicinity of the center 10C. The conductive portion $16^4$C covers the entire surface of each vane. A non-conductive planar support member 32 may be used.

If desired, the vanes $16^4$-1 and $16^4$-4 may themselves be connected by a length of a non-conductive member $16^4$N. The member $16^4$N is shown in FIG. 10A in dashed outline with stipled shading.

In a second aspect, the invention is directed to various implementations of a collapsible self-supporting field director structure embodying the teachings of the present invention.

FIGS. 11, 12, 13A and 13B illustrate a field director structure formed from a single vane. In each implementation the vane has a zone of inflection whereby a planar vane may be formed into a self-supporting structure oriented in a predetermined orientation with respect to a predetermined reference plane RP disposed within the oven M. The plane RP may be conveniently defined as a plane in which the surface of a turntable or the surface of a food product or other article disposed within the oven.

Figure 11:
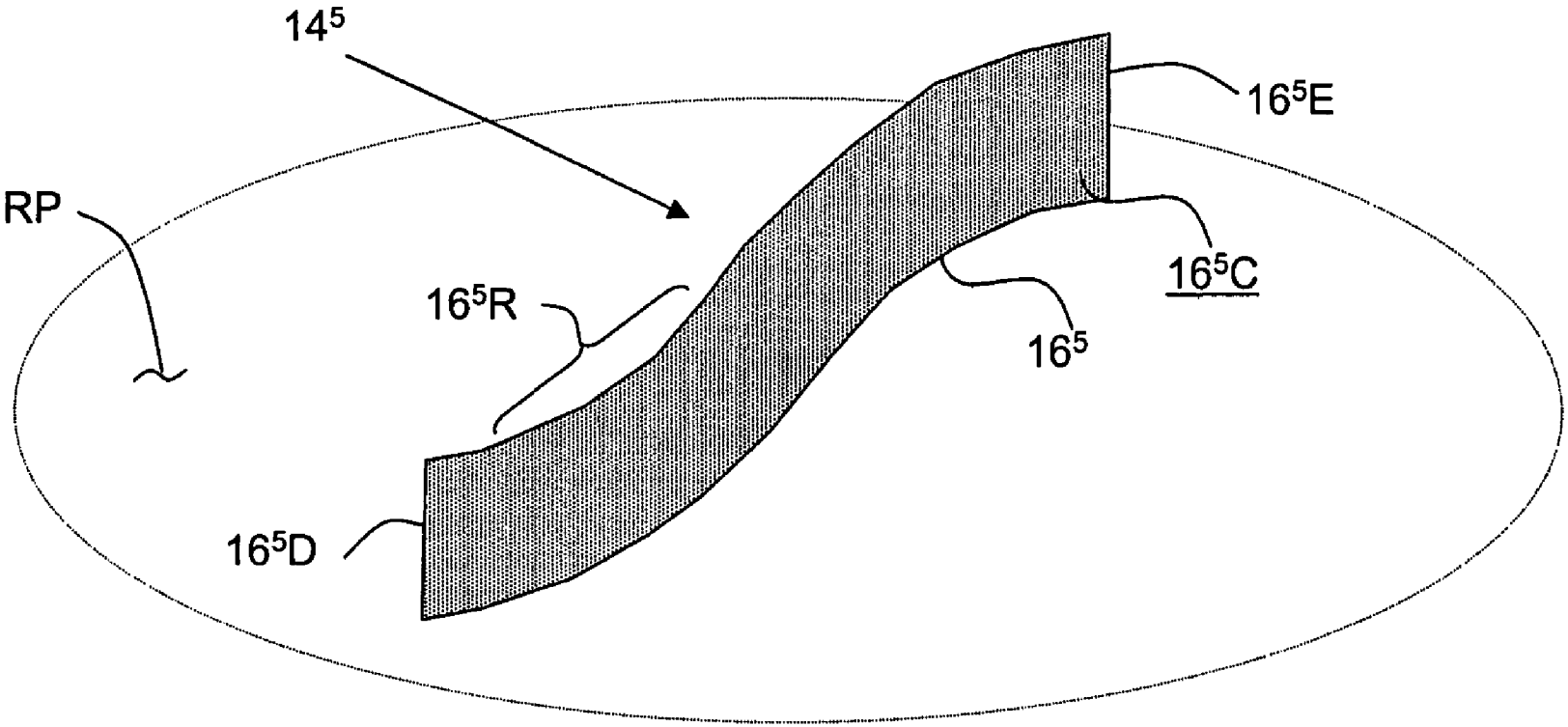
FIG. 11 is a pictorial view of a field director structure in accordance with the invention implemented using a single curved vane.

In FIG. 11 the field director structure $14^5$ is implemented using a single curved vane $16^5$. The vane $16^5$ may be curved or may have least one region of flexure or curvature $16^5$R defined between the first and second ends $16^5$D and $16^5$E. The conductive portion $16^5$C covers the entire surface of the vane. In use, the vane $16^5$ may be formed into a self-supporting structure arranged in a predetermined orientation with respect to a predetermined reference plane RP.

Figure 12:
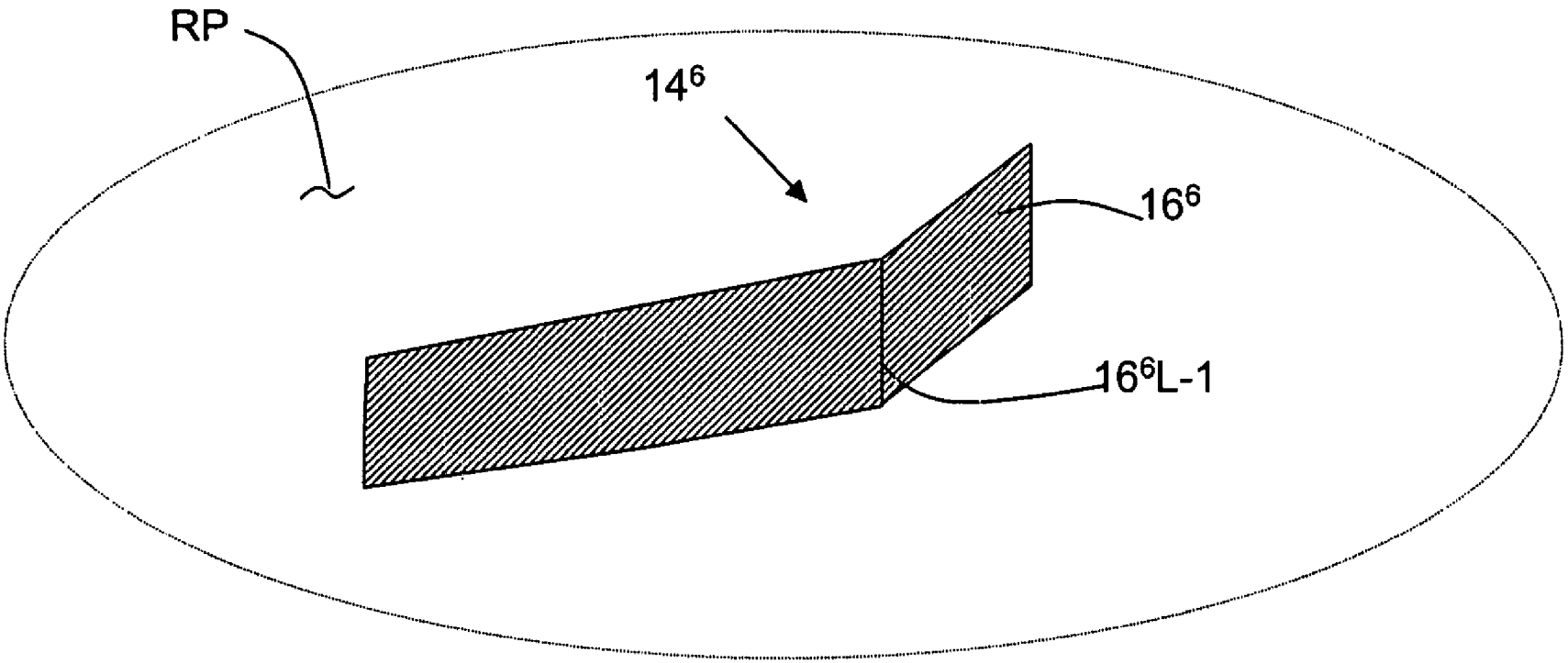
FIG. 12 is a pictorial view of a field director structure in accordance with the invention implemented using a planar vane with a single bend line therein.

In the field director structure $14^6$ shown in FIG. 12 the vane $16^6$ has a single fold or bend line $16^6$L-1 herein. In use, the vane $16^6$ may be folded or bent along the bend line $16^6$L-1 to define a self-supporting structure lying in a predetermined orientation with respect to a predetermined reference plane RP within the oven M. The same effect may be achieved by flexibly attaching two straight-edged vanes along a flexible line of connection in place of the fold or bend line.

Figure 13B:
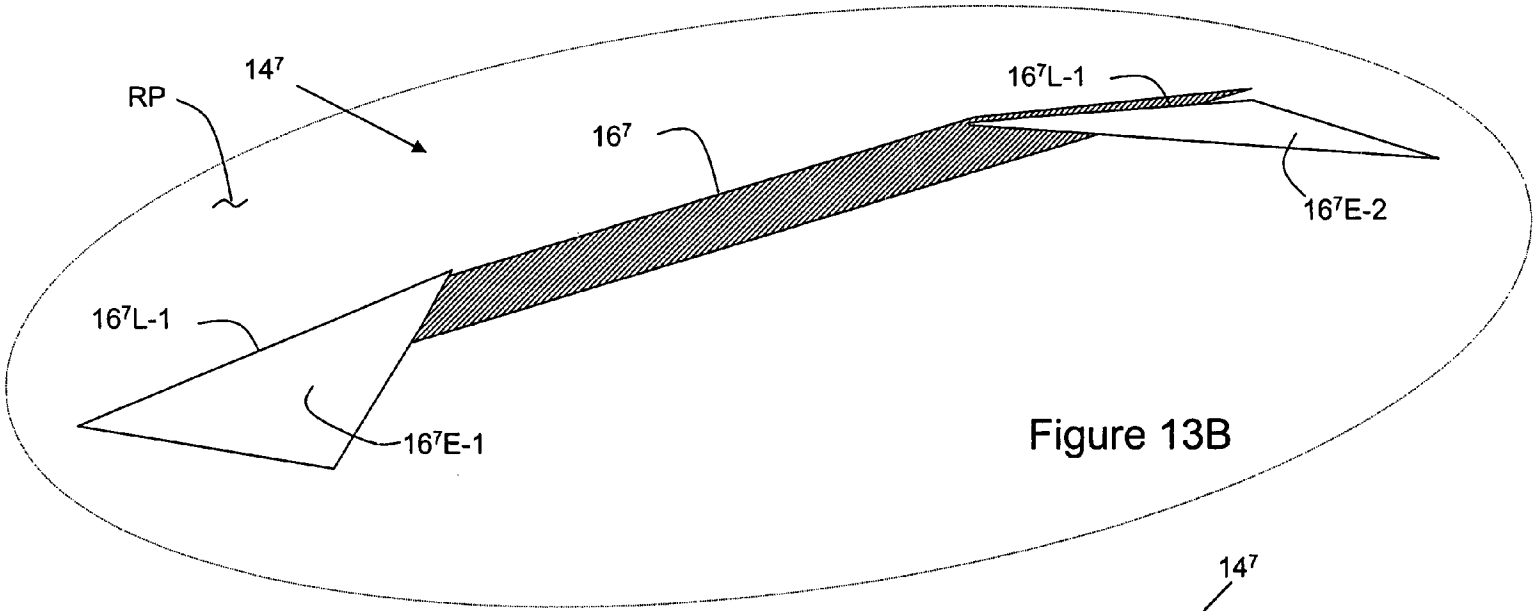
FIGS. 13A and 13B are respective elevational and pictorial views of a field director structure in accordance with the invention implemented using a planar vane with two bend line therein.
Figure 13A:
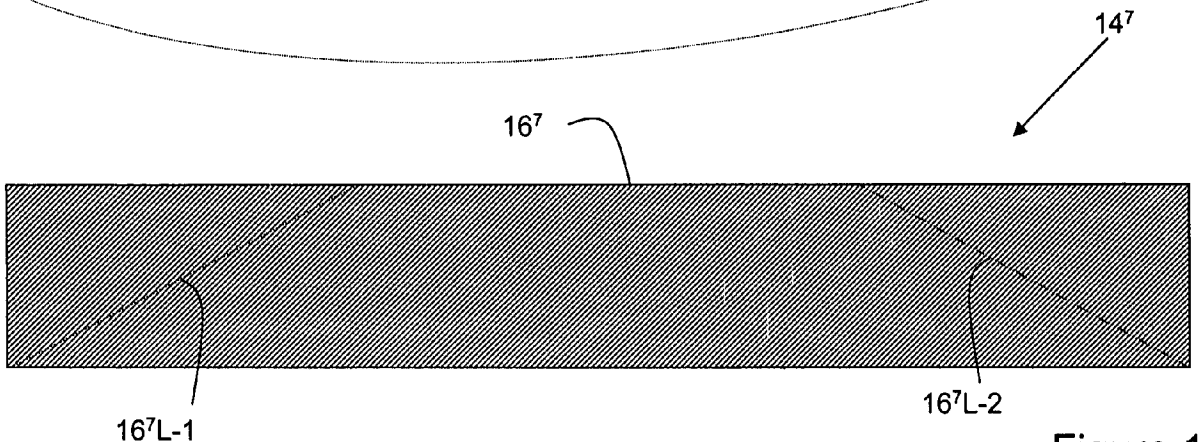

FIGS. 13A and 13B are respective elevational and pictorial views of a field director structure $14^7$ implemented using a conductive planar vane $16^7$ with two bend lines $16^7$L-1 and $16^7$L-2. Bending the vane $16^7$ along the bend lines $16^7$L-1 and $16^7$L-2 forms ears $16^7$E-1 and $16^7$E-2 that serve to support the planar vane in a predetermined desired orientation with respect to the predetermined reference plane RP within the oven M.

Figure 14:
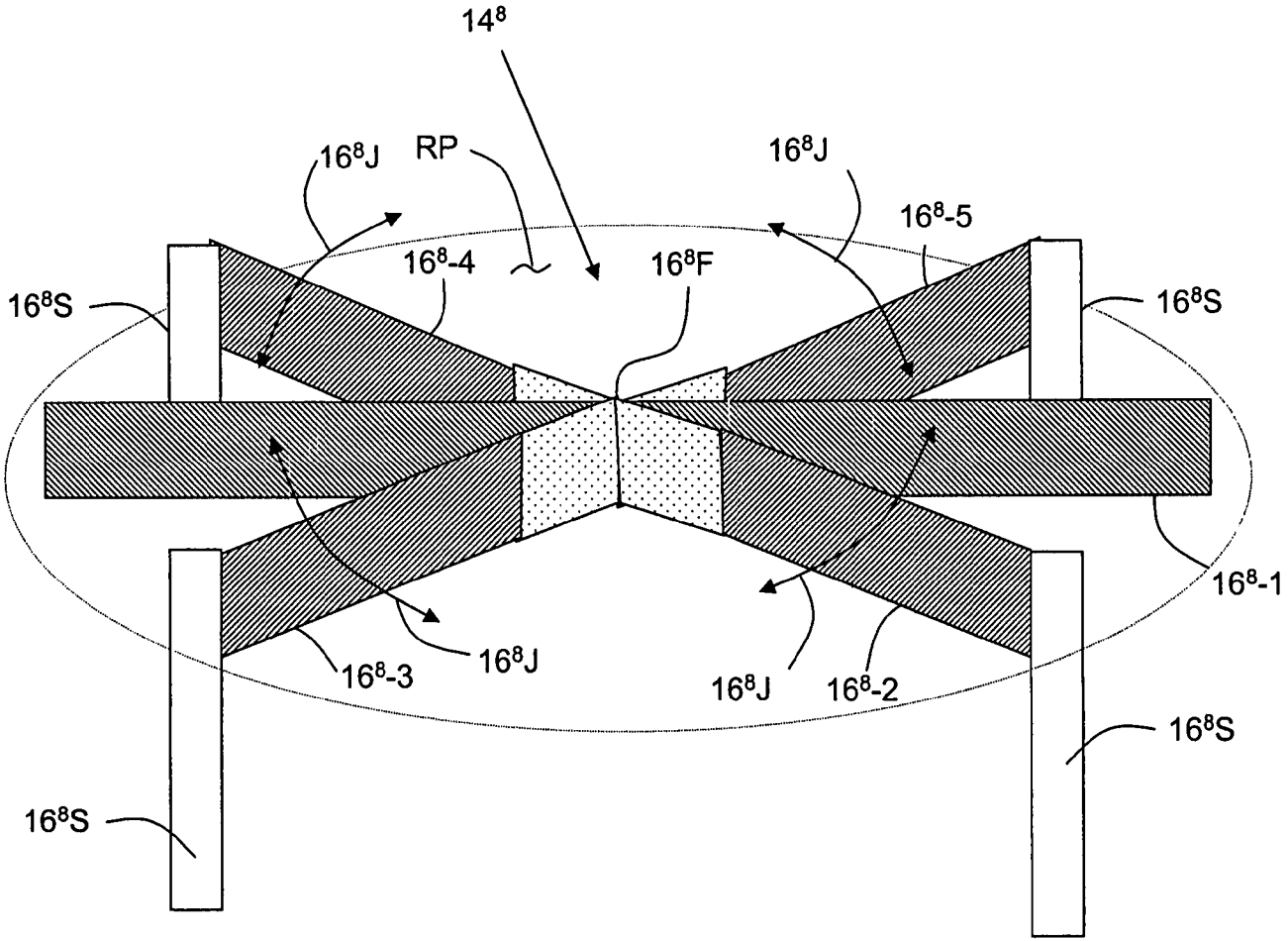
FIGS. 14 and 15 are pictorial views of two additional implementations of a field director structure in accordance with the invention each having a plurality of vanes flexibly connected to form a collapsible structure.
Figure 15:
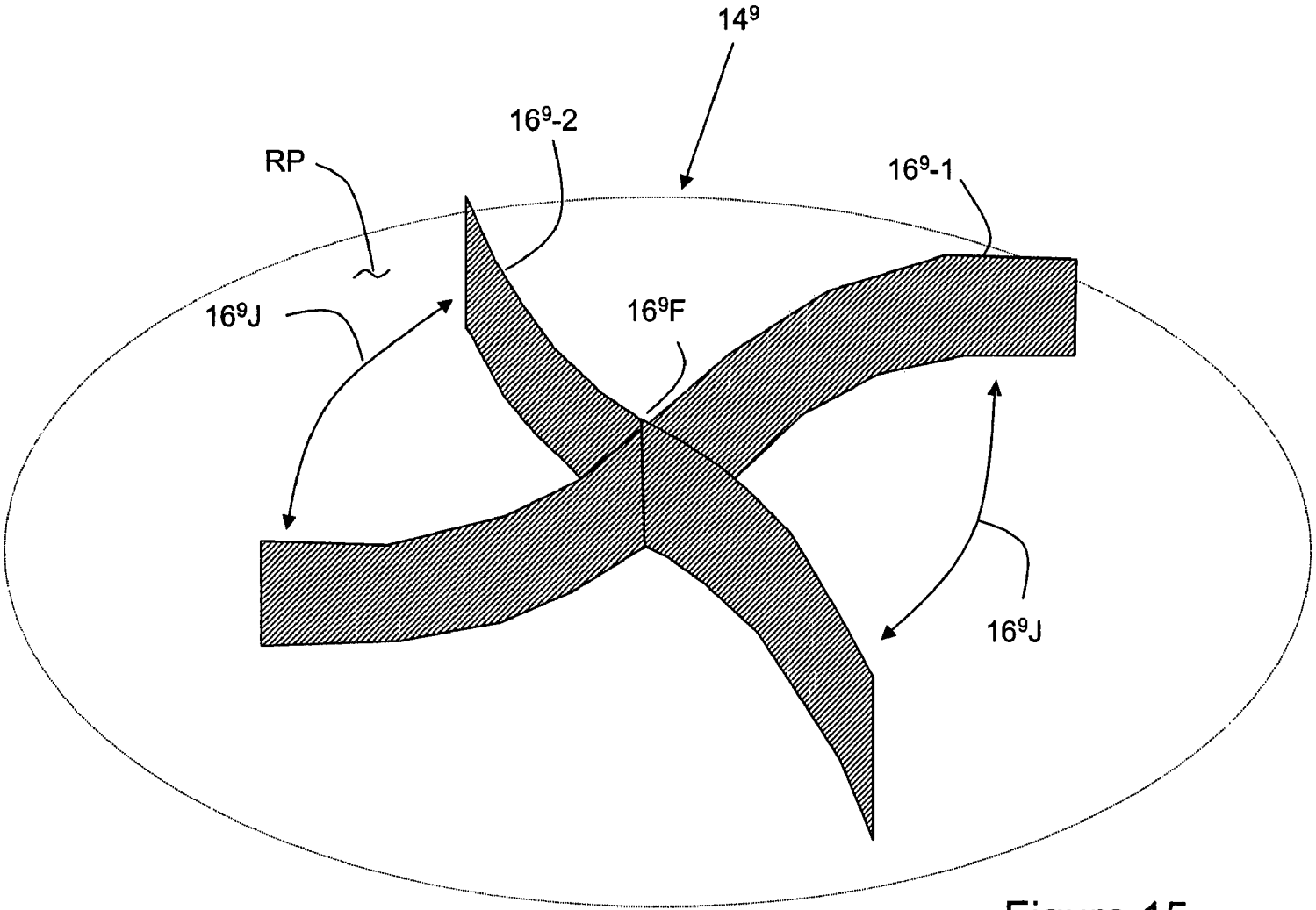

FIGS. 14 and 15 are pictorial views of two additional implementations of a collapsible self-supporting field director structure in accordance with the invention. Each field director structure has a vane array that includes a plurality of vanes flexibly connected to form a structure that may be made self-supporting.

In the field director structure $14^8$ shown in FIGS. 14 and 15 the vane array comprising vanes $16^8$-1 through $16^8$-5, each vane having an electrically conductive surface thereon. Each vane is flexibly connected at a point of connection $16^8$F to at least one other vane. The flexibly connected vanes are able to be fanned toward and away from each other, as suggested by the arrows $16^8$J. In use, with the vanes in the array spread from each other the field director is able to be self-supporting with each vane in the array being disposed in a predetermined orientation with respect to a predetermined reference plane RP within the oven. In a modified embodiment a strut $16^8$S may be connected to the free end of each of at least three vanes. The struts are fabricated of any material transparent to microwave energy.

The field director structure $14^9$ shown in FIG. 15 comprises a pair of vanes $16^9$-1 and $16^9$-2, each vane having an electrically conductive surface thereon. Each vane is flexibly connected at a point of connection $16^9$F to the one other vane. The flexibly connected vanes are able to be fanned toward and away from each other, as suggested by the arrows $16^9$J. In use, with the vanes in the array spread from each other the field director is able to be self-supporting with each vane in the array being disposed in a predetermined orientation with respect to a predetermined reference plane within the oven.

Although the vanes in each of the embodiments illustrated in FIG. 11 through 15 are shown with the conductive portions extending over the over the entire surface of vane, it should be understood that the conductive portion of any of the vanes may exhibit any alternative shape.

Figure 16:
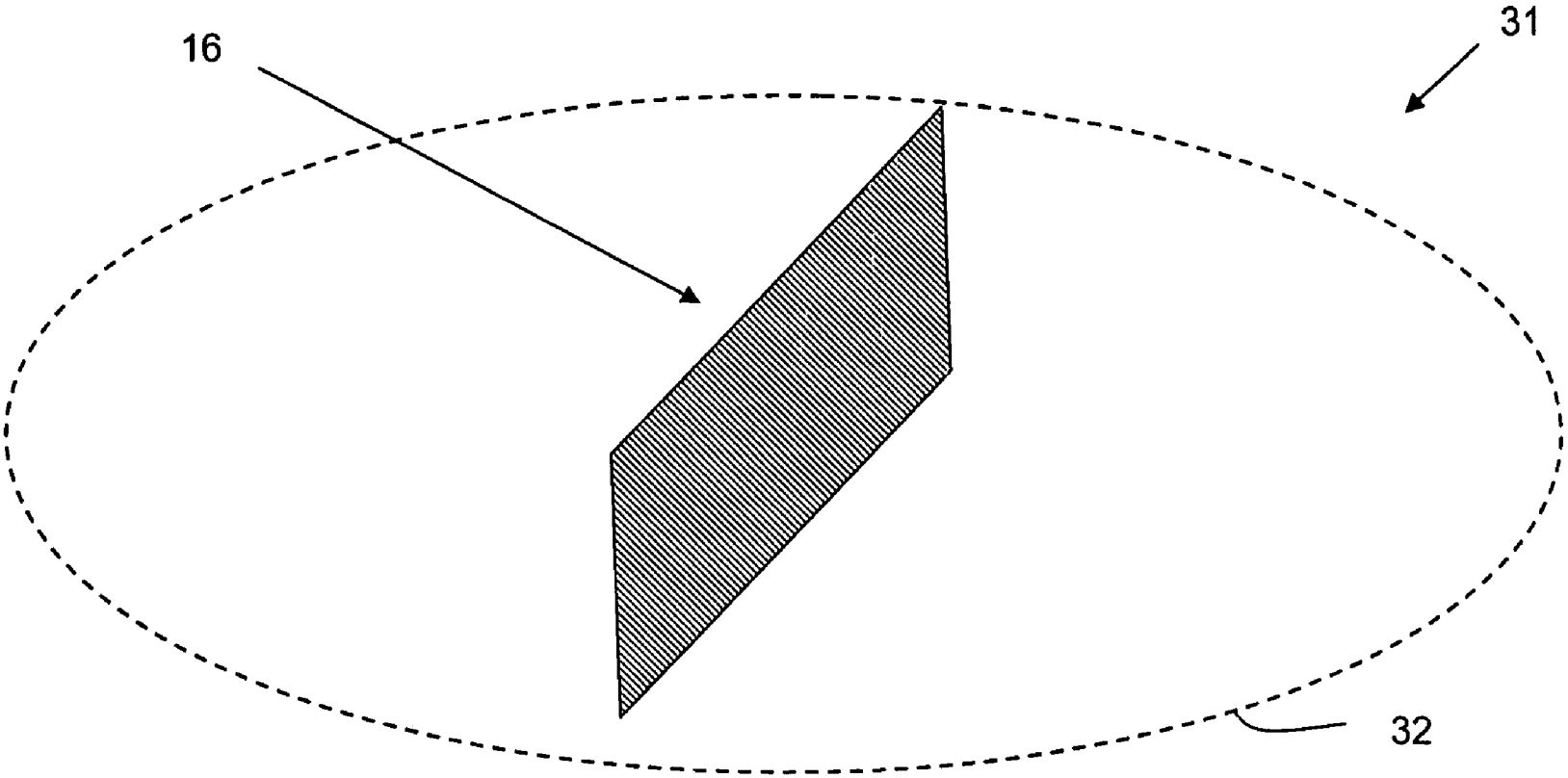
FIG. 16 is a pictorial view of a field director assembly in accordance with the present invention wherein at least one vane is supported on a nonconducting substrate.

It should also be appreciated that a field director structure of the present invention need not be made collapsible, but instead may be made self-supporting through the use of a suitable non-conductive support member. FIG. 16 is a pictorial view of a field director assembly generally indicated by the reference character 31. The field director assembly 31 shown in FIG. 16 comprises at least one vane 16 connected to a planar non-conductive support member 32 whereby the conductive surface of the vane is oriented in a predetermined orientation (shown as generally orthogonal to the support member). If additional vanes are provided, these additional vanes are supported on the same support member. The vanes may or may not be connected to each other, as desired. The support member may be connected below or above the vane (s).

It should also further be appreciated that any embodiment of a field director structure falling within the scope of the present invention may be used with a separate planar susceptor (earlier described). It should also be appreciated that for some food products it may be desirable to place a second planar susceptor above the food product or to wrap the food product with a flexible susceptor.

Examples 1-8

The operation of the field director structure and a susceptor assembly in accordance with the present invention may be understood more clearly from the following examples.

Introduction

For all of the following examples commercially available microwavable pizzas (DiGiorno® Microwave Four Cheese Pizza, 280 grams) were used in the cooking experiments.

A planar susceptor comprised of a thin layer of vapor-deposited aluminum sandwiched between a polyester film and paperboard was provided with the pizza in the package. This planar susceptor was used with various implementations of the field director structure of the present invention, as will be discussed. The edge of the paperboard provided was shaped to form an inverted U-shape cooking tray to space the planar susceptor approximately 2.5 cm above a turntable in the microwave oven. A crisping ring (intended for browning the edges of the pizza) provided with the pizza in the package was not used.

In all examples the planar susceptor was placed directly upon a turntable of a microwave oven. In all examples frozen pizzas were placed directly on the planar susceptor and cooked at full power for 5 minutes, except for Example 5, which was cooked in a lower power over for 7.5 minutes.

For comparison purposes one group of three pizzas was cooked using only the planar susceptor without a field director structure, and another group of three pizzas was cooked using the planar susceptor with a field director structure of the present invention.

The vanes of each field director were constructed using aluminum foil of 0.002 inch (0.05 millimeter) thickness, paperboard, and tape.

For Examples 1 through 7 the field director structure was placed in the space under the planar susceptor. For Example 8 the field director structure was positioned above the pizza.

Browning and Browning Profile Measurements

The percent browned and the browning profile of the pizza bottom crust were measured following a procedure described in Papadakis, S. E., et al. "A Versatile and Inexpensive Technique for Measuring Color of Foods," *Food Technology,* 54 (12) pp. 48-51 (2000). A lighting system was set up and a digital camera (Nikon, model D1) was used to acquire images of the bottom crust after cooking. A commercially available image and graphics software program was used to convert color parameters to the L-a-b color model, the preferred color model for food research. Following the suggestion from the referenced procedure the percent browned area was defined as percent of pixels with a lightness L value of less than 153 (on a lightness scale of 0 to 255, 255 being the lightest). Following the methodology described in the referenced procedure the browning profile (i.e., the percent browned area as a function of radial position) was calculated.

The image of the bottom crust was divided into multiple concentric annular rings and the mean L value was calculated for each annular ring.

The following examples are believed to illustrate the improvements in browning and browning uniformity that resulted from the use of different field director structures of the present invention.

Example 1

A DiGiorno® Microwave Four Cheese Pizza was cooked in an 1100-watt General Electric (GE) brand microwave oven, Model Number JES1036WF001, in the manner described in the introduction. When a field director was employed, the field director structure in accordance with FIG. 14 (without the struts $\mathbf{16}^{8}$S) was used. The vane $\mathbf{16}^{8}$-1 had a length dimension of 17.5 centimeters, and a width dimension of 2 centimeters. The vanes vane $\mathbf{16}^{8}$-2 through $\mathbf{16}^{8}$-5 each had a length dimension of 8 centimeters and a width dimension of 2 centimeters.

After cooking an image of the bottom crust was acquired with the digital camera, as described. From the image data the percent browned area was calculated using the procedures described. The average percent browned area for the pizzas cooked without a field director was determined to be 40.3%. The average percent browned area for the pizzas cooked with a field director was determined to be 60.5%.

Examples 2 to 5

The experiment described in Example 1 was repeated in four microwave ovens of different manufacturers. The oven manufacturer, model number, full power wattage, and cooking time for each example are summarized in Table 1. The table reports the percent browned area achieved with and without a field director. It should be noted that the percent browned area was improved in all cases.

TABLE 1

Comparison of percent browned area with and without field director

| | Example | | | | |
|---|---|---|---|---|---|
| | 1 | 2 | 3 | 4 | 5 |
| Oven brand | GE | Sharp | Panasonic | Whirlpool | Goldstar |
| Wattage | 1100 | 1100 | 1250 | 1100 | 700 |
| Model # | JES1036WF001 | R-630DW | NN5760WA | MT4110SKQ | MAL783W |
| Cooking time | 5 min | 5 min | 5 min | 6 min | 7.5 min |
| | Percent Browned Area | | | | |
| W/field director | 60.5% | 70.7% | 61.7% | 60.7% | 51.4% |
| w/out field director | 40.3% | 55.2% | 50.3% | 15.3% | 31.5% |

Example 6

A DiGiorno® Microwave Four Cheese Pizza, 280 gram, was cooked in an 1100-watt Sharp brand oven, Model R-630DW. When a field director structure was employed, the field director structure in accordance with FIG. 15 was used. The vanes $\mathbf{16}^{9}$-1 and $\mathbf{16}^{9}$-2 had a length dimension of 22.9 centimeters and a width dimension of 2 centimeters. The radius of curvature for each portion of a curved vane extending from the point of connection 16[9]F was approximately 5.3 cm and had an angle of arc of approximately 124 degrees.

After cooking an image of the bottom crust was acquired with the digital camera and the percent browned area was calculated, all as described.

Figure 17:
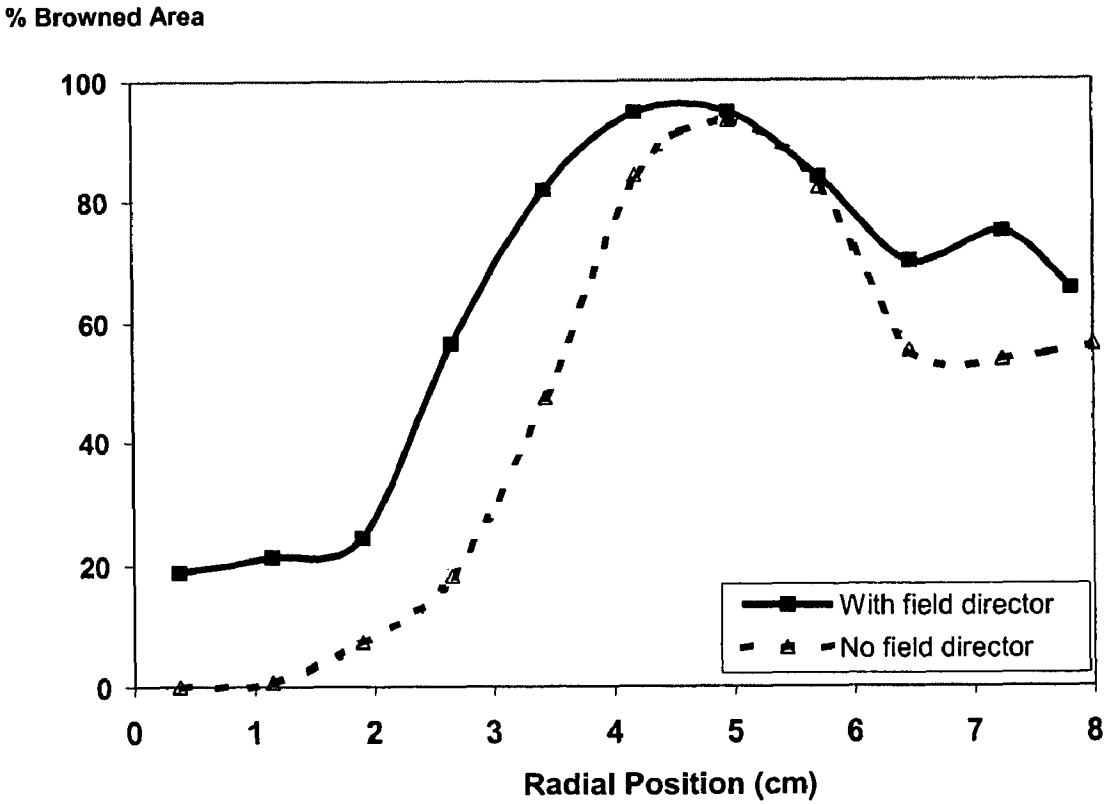
FIGS. 17 and 18 are plots of the results of Examples 6 and 7, respectively.

The average percent browned area for the pizzas cooked without a field director was 55.2%. The average percent browned area for the pizzas cooked with the field director was determined to be 73.8%. The browning profile, was plotted and is shown in FIG. 17.

Example 7

Figure 18:
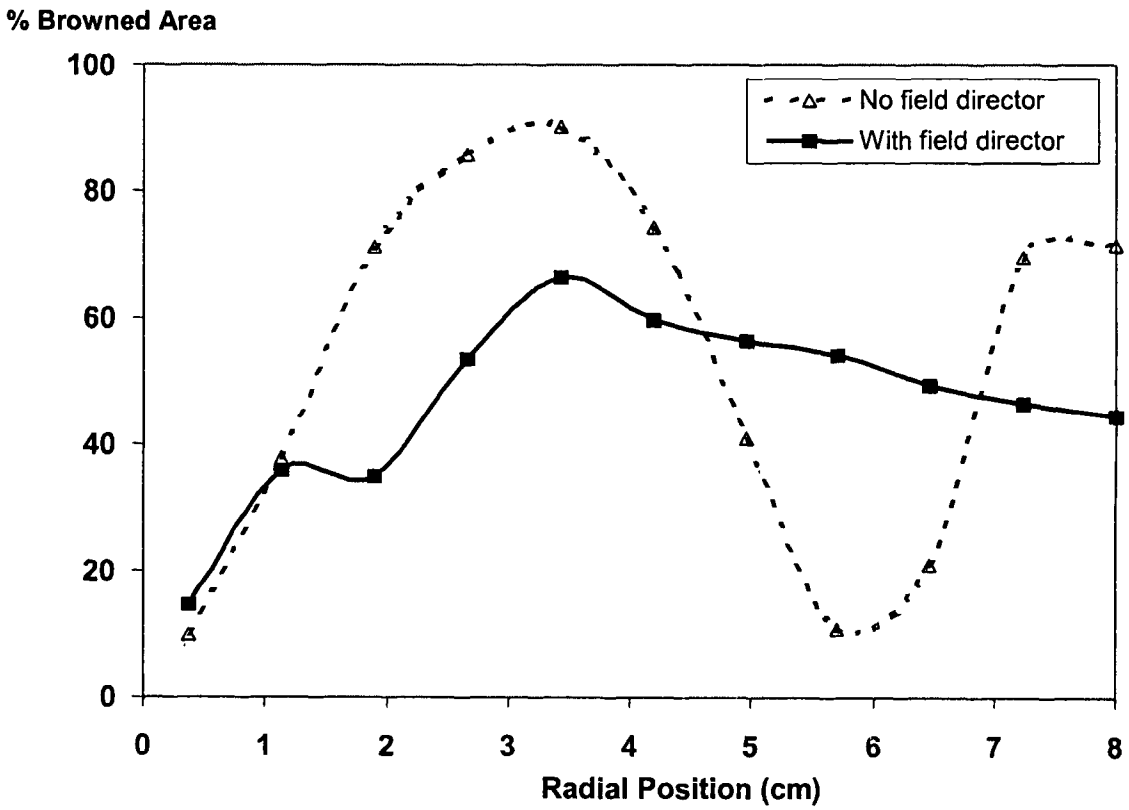

The experiment described in Example 6 was repeated using a 1300-watt Panasonic brand oven, Model NN5760WA. The average percent browned area for the pizza cooked without a field director was 50.3%. The average percent browned area for the pizzas cooked with a field director structure was determined to be 51.7%. The substantially uniform browning profile that follows from the use of the present invention may be observed from the plot shown in FIG. 18. From observation of FIG. 18 it can be appreciated that the browning profile along the radius was greatly improved with the use of a field director structure.

Example 8

The experiment described in Example 1 was repeated in a 700-watt Goldstar brand microwave oven, Model MAL783W. When a field director structure was employed, the field director structure in accordance with FIG. 14 with the struts 16[8]S was used. The struts were 5 centimeters in height and were placed on the turntable to support the field director just above the pizza. The field director structure barely touched the top of the pizza after the pizza crust had risen.

After cooking (for 7.5 minutes at full power of the oven used) an image of the bottom crust was acquired with the digital camera and the percent browned area was calculated, all as described.

The percent browned area for the pizza cooked without a field director was 31.5%. The percent browned area for the pizza cooked with a field director was 65.1%.

Those skilled in the art, having the benefit of the teachings of the present invention may impart modifications thereto. Such modifications are to be construed as lying within the scope of the present invention, as defined by the appended claims.

What is claimed is:

1. A susceptor assembly for use in a microwave oven, the susceptor assembly comprising:

a generally planar susceptor including an uninterrupted electrically lossy layer, the electrically lossy layer defining a generally planar presentation surface able to accept an article for presentation to the resonant cavity of a microwave oven, the susceptor having a second generally planar opposed surface;

at least one vane having a connection edge and a single free edge thereon, the vane being mechanically connected along its connection edge to the opposed surface of the susceptor such that substantially the entire length of the vane is overlaid by the opposed surface of the susceptor, the vane having a surface thereon, at least a portion of the surface of the vane being electrically conductive, the connection edge of the vane and the planar susceptor intersecting along a line of intersection, the line of intersection extending in a generally transverse direction with respect to the planar susceptor, the electrically conductive portion of the vane being disposed no farther than a predetermined close distance from the electrically lossy layer of the planar susceptor, so that in the presence of a standing electromagnetic wave only an attenuated electric field component of the electromagnetic wave exists in a plane tangent to the surface of the vane in the vicinity of the conductive portion of the vane, attenuation of the electric field component of the electromagnetic wave in the plane tangent to the surface of the vane resulting in enhancement of the components of the electric field in the planar susceptor.

2. The susceptor assembly of claim 1 wherein the vane is connected to the planar susceptor by a fixed connection so that the surface of the vane is oriented at an angle between about forty-five degrees (45°) and ninety degrees (90°) with respect to the planar susceptor.

3. The susceptor assembly of claim 2 wherein the vane is connected to the planar susceptor by a fixed connection so that the surface of the vane is substantially orthogonal to the planar susceptor.

4. The susceptor assembly of claim 1 wherein the vane is connected to the planar susceptor by a flexible connection so that the surface of the vane is movable from a stored position to a deployed position, in the deployed position the surface of the vane is oriented at an angle between about forty-five degrees (45°) and ninety degrees (90°) with respect to the planar susceptor.

5. The susceptor assembly of claim 1 wherein the microwave oven is operative to generate a standing electromagnetic wave having a predetermined wavelength, and wherein the predetermined close distance is less than 0.25 of the wavelength.

6. The susceptor assembly of claim 1 wherein the predetermined close distance is selected such that the electric field component of the electromagnetic wave in the plane tangent to the surface of the vane in the vicinity of the conductive portion of the vane is substantially zero.

7. The susceptor assembly of claim 1 wherein the vane has a straight edge thereon.

8. The susceptor assembly of claim 7 wherein the microwave oven is operative to generate a standing electromagnetic wave having a predetermined wavelength, and wherein the edge of the vane has a predetermined length, the predetermined length of the vane being in the range from about 0.25 to about twice the wavelength.

9. The susceptor assembly of claim 1 wherein the surface of the vane folded along a fold line such that the vane has a bent edge thereon.

10. The susceptor assembly of claim 9 wherein the microwave oven is operative to generate a standing electromagnetic wave having a predetermined wavelength, and wherein the edge of the vane has a predetermined length, the predetermined length of the vane being in the range from about 0.25 to about twice the wavelength.

11. The susceptor assembly of claim 1 wherein the vane has a curved edge thereon.

12. The susceptor assembly of claim 11 wherein the microwave oven is operative to generate a standing electromagnetic wave having a predetermined wavelength, and wherein the edge of the vane has a predetermined length, the predetermined length of the vane being in the range from about 0.25 to about twice the wavelength.

13. The susceptor assembly of claim 1 wherein the planar susceptor has a center, the line of intersection extending in a generally radial direction emanating from the vicinity of the center.

14. The susceptor assembly of claim 13 wherein the electrically conductive portion on the surface of the vane has a trapezoidal shape with a long side and a short side, and wherein the long side of the trapezoid is disposed on the vane in the vicinity of the center.

15. The susceptor assembly of claim 13 wherein the electrically conductive portion on the surface of the vane has a trapezoidal shape with a long side and a short side, and wherein the short side of the trapezoid is disposed on the vane in the vicinity of the center.

16. The susceptor assembly of claim 1 wherein the planar susceptor has a center, the line of intersection extends through the center.

17. The susceptor assembly of claim 1 wherein the planar susceptor has a center, the line of intersection being offset from a generally radial direction emanating from the vicinity of the center.

18. The susceptor assembly of claim 1 wherein the planar susceptor has a center, the line of intersection being inclined with respect to a generally radial direction emanating from the vicinity of the center.

19. The susceptor assembly of claim 1 wherein the microwave oven is operative to generate a standing electromagnetic wave having a predetermined wavelength, and wherein the vane has predetermined width dimension, the width of the vane being from about 0.1 to about 0.5 times the wavelength.

20. The susceptor assembly of claim 1 wherein the surface of the vane is planar.

21. The susceptor assembly of claim 1 wherein the surface of the vane is curved.

22. The susceptor assembly of claim 1, wherein the planar susceptor has an electrical conductivity in the range of 0.01 to 100 milliSiemens per square.

23. The susceptor assembly of claim 1, wherein the planar susceptor comprises a substrate and an electrically conductive layer.

24. The susceptor assembly of claim 23, wherein the substrate of the planar susceptor is comprised of a material selected from the group consisting of polyethylene terephalate (PET), heat stabilized PET, PEEK™, polyethylene naphthalate (PEN), cellophane, polyimides, polyetherimides, polyesterimides, polyarylates, polyamides, polyolefins (PP), polyaramids, and polycyclohexylenedimethylene terephthalate (copolyester PCDMT).

25. A susceptor assembly for use in a microwave oven, the susceptor assembly comprising:

a generally planar susceptor having a geometric center, the planar susceptor including an uninterrupted electrically lossy layer, the electrically lossy layer defining a generally planar presentation surface able to accept an article for presentation to the resonant cavity of a microwave oven, the susceptor having a second generally planar opposed surface;

at least five vanes each having a connection edge and a single free edge thereon, each vane being mechanically connected along its connection edge to the opposed surface of the susceptor such that substantially the entire length of the vane is overlaid by the opposed surface of the susceptor, each vane having a surface thereon, at least a portion of the surface of each vane being electrically conductive, the surface of each vane being substantially orthogonal with respect to the opposed surface of the planar susceptor, the vanes being arrayed substantially radially with respect to the geometric center of the susceptor with the connection edge of one of the vanes passing through the geometric center of the planar susceptor, the electrically conductive portion of each vane being disposed no farther than a predetermined close distance from the electrically lossy layer of the planar susceptor, so that in the presence of a standing electromagnetic wave only an attenuated electric field component of the electromagnetic wave exists in a plane tangent to the surface of each vane in the vicinity of the conductive portion of that vane, attenuation of the electric field component of the electromagnetic wave in the plane tangent to the surface of the vane resulting in enhancement of the components of the electric field in the planar susceptor.

26. A susceptor assembly for use in a microwave oven, the susceptor assembly comprising:

a generally planar susceptor having a geometric center, the planar susceptor including an uninterrupted electrically lossy layer, the electrically lossy layer defining a generally planar presentation surface able to accept an article for presentation to the resonant cavity of a microwave oven, the susceptor having a second generally planar opposed surface;

at least six vanes each having a connection edge and a single free edge thereon, each vane being mechanically connected along its connection edge to the opposed surface of the susceptor such that substantially the entire length of the vane is overlaid by the opposed surface of the susceptor, each vane having a surface thereon, at least a portion of the surface of each vane being electrically conductive, the surface of each vane being substantially orthogonal with respect to the opposed surface of the planar susceptor, the vanes being arrayed substantially radially with respect to the geometric center of the susceptor with the connection edge of one of the vanes passing through the geometric center of the planar susceptor, the electrically conductive portion of each vane being disposed no farther than a predetermined close distance from the electrically lossy layer of the planar susceptor, so that in the presence of a standing electromagnetic wave only an attenuated electric field component of the electromagnetic wave exists in a plane tangent to the surface of each vane in the vicinity of the conductive portion of that vane, attenuation of the electric field component of the electromagnetic wave in the plane tangent to the surface of the vane resulting in enhancement of the components of the electric field in the planar susceptor.

* * * * *